US008123211B2

(12) United States Patent
Akiyama et al.

(10) Patent No.: US 8,123,211 B2
(45) Date of Patent: Feb. 28, 2012

(54) PICKUP ROLLER LIFTING AND LOWERING MECHANISM IN PAPER FEEDING UNIT AND IMAGE FORMING APPARATUS INCLUDING THE PICKUP ROLLER LIFTING AND LOWERING MECHANISM

(75) Inventors: Koichi Akiyama, Kanagawa (JP); Wataru Ikeda, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 181 days.

(21) Appl. No.: 12/497,016

(22) Filed: Jul. 2, 2009

(65) Prior Publication Data

US 2010/0007078 A1 Jan. 14, 2010

Related U.S. Application Data

(60) Provisional application No. 61/079,723, filed on Jul. 10, 2008, provisional application No. 61/079,733, filed on Jul. 10, 2008, provisional application No. 61/081,683, filed on Jul. 17, 2008.

(51) Int. Cl.
*B65H 3/06* (2006.01)

(52) U.S. Cl. ..... 271/117; 271/126; 271/127; 271/153; 271/164

(58) Field of Classification Search ..... 271/117, 271/126, 127, 162, 164, 153, 157
See application file for complete search history.

(56) References Cited

U.S. PATENT DOCUMENTS

| | | | | |
|---|---|---|---|---|
| 4,900,003 | A * | 2/1990 | Hashimoto | 271/118 |
| 5,501,444 | A * | 3/1996 | Yukimachi et al. | 271/117 |
| 6,299,157 | B1 | 10/2001 | Lim | |
| 7,513,496 | B2 * | 4/2009 | Hattori | 271/117 |

FOREIGN PATENT DOCUMENTS

| | | |
|---|---|---|
| JP | 03-227850 | 10/1991 |
| JP | 05-162870 | 6/1993 |
| JP | 05-213483 | 8/1993 |
| JP | 07-172624 | 7/1995 |
| JP | 2004-292093 | 10/2004 |

* cited by examiner

*Primary Examiner* — Gerald McClain
(74) *Attorney, Agent, or Firm* — Patterson & Sheridan, LLP

(57) ABSTRACT

A pressing projection of a paper feeding cassette presses a push-back mechanism to thereby release urging of a cam gear in a direction opposite to a direction of the paper feeding cassette. The cam gear moves in the direction of the paper feeding cassette. A cam of the cam gear rotates a rotation lever. The rotation lever rotates a pickup roller lifting and lowering shaft. The pickup roller lifting and lowering shaft lowers a pickup roller.

18 Claims, 23 Drawing Sheets

PICKUP ROLLER LIFTING AND LOWERING MECHANISM IN PAPER FEEDING UNIT AND IMAGE FORMING APPARATUS INCLUDING THE PICKUP ROLLER LIFTING AND LOWERING MECHANISM

CROSS-REFERENCE TO RELATED APPLICATIONS

This application is based upon and claims the benefit of priority from the prior the U.S. Patent Application No. 61/079,723, filed on 10 Jul., 2008, the prior the U.S. Patent Application No. 61/079,733, filed on 10 Jul., 2008, and the prior the U.S. Patent Application No. 61/081,683, filed on 17 Jul., 2008, the entire contents of which are incorporated herein by reference.

TECHNICAL FIELD

The present invention relates to a pickup roller lifting and lowering mechanism with improved lowering timing in a paper feeding unit and an image forming apparatus including the lifting and lowering mechanism.

BACKGROUND

In an image forming apparatus such as a copying machine, a MFP (Multifunction Peripheral), or a printer, recording media such as paper are stored in a paper feeding cassette. In image formation, the image forming apparatus extracts the recording media one by one from the paper feeding cassette. The image forming apparatus extracts the recording media from the paper feeding cassette using a pickup roller.

In an image forming apparatus in the past, a pickup roller falls as a paper feeding cassette is inserted into the image forming apparatus (e.g., JP-A-5-162870).

Therefore, when the paper feeding cassette is inserted into the image forming apparatus or drawn out from the image forming apparatus, the pickup roller may come into contact with recording media stacked in the paper feeding cassette. In order to avoid this contact, the size of an apparatus body in the vertical direction has to be set large.

SUMMARY

It is an object of the present invention to provide a pickup roller lifting and lowering mechanism of a paper feeding unit that can lower a pickup roller after a paper feeding cassette is completely inserted.

In an aspect of the present invention, a pickup roller lifting and lowering mechanism includes:

a lifting and lowering driving mechanism having a base disc, which is a disc perpendicular to a rotation axis, and a cam that is set in contact with the base disc, the lifting and lowering driving mechanism including a cam gear urged in a direction opposite to an inserting direction of a paper feeding cassette in which recording media are stacked and a push-back mechanism that urges the cam gear in a direction opposite to the paper feeding cassette and releases the urging of the cam gear in the inserting direction of the paper feeding cassette by being pressed by a pressing projection provided in the paper feeding cassette;

a rotation lever rotated by the cam and the base disc;

a pickup roller lifting and lowering shaft rotated by the rotation lever; and a pickup roller lowered by the rotation of the pickup roller lifting and lowering shaft.

DETAILED DESCRIPTION

Throughout this description, the embodiments and examples shown should be considered as exemplars, rather than limitations on the apparatus and methods of the present invention.

A pickup roller lifting and lowering mechanism in a paper feeding unit and an image forming apparatus including the lifting and lowering mechanism according to an embodiment of the present invention are explained in detail below with reference to the accompanying drawings.

Overview of the Image Forming Apparatus

An image forming apparatus of an electrophotographic system is explained below as an example. An image forming system of the image forming apparatus may be an ink jet system or other image forming systems.

Figure 1:
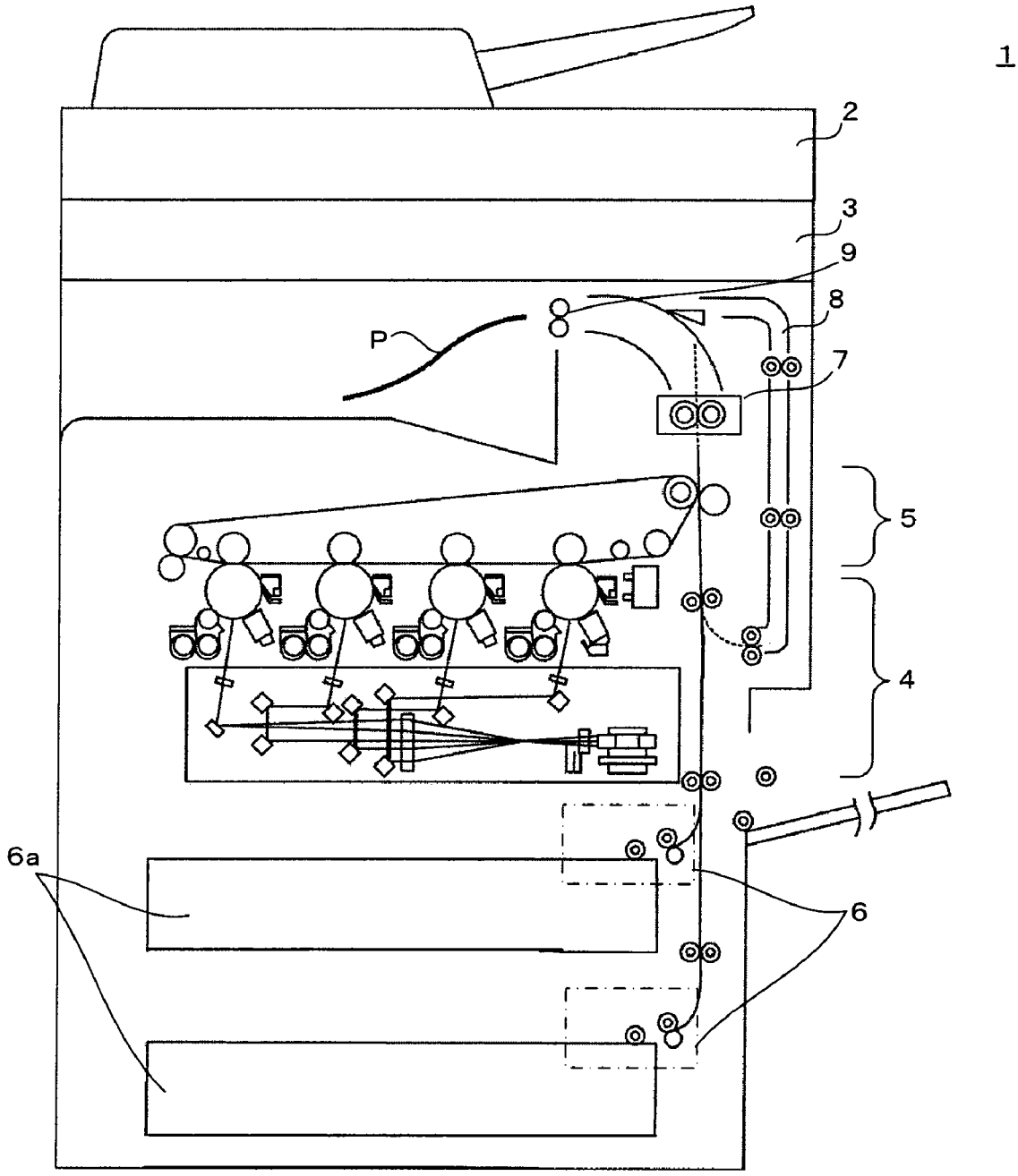
FIG. 1 is a schematic diagram of a schematic configuration of an image forming apparatus.

FIG. 1 is a schematic diagram of a configuration of the image forming apparatus of the electrophotographic system according to this embodiment. As shown in FIG. 1, an image forming apparatus 1 includes an auto document feeder 2, an image reading unit 3, an image forming unit 4, a transfer mechanism 5, a sheet conveying mechanism, paper feeding units 6, a fixing unit 7, a reverse conveying mechanism 8, and a discharging mechanism 9.

The auto document feeder 2 is openably and closably set in an upper part of a main body of the image forming apparatus 1. The auto document feeder 2 includes a document conveying mechanism that extracts original documents from a document tray one by one and conveys the original document to a paper discharge tray.

The auto document feeder 2 conveys, with the document conveying mechanism, the original documents to a document reading unit of the image reading unit 3 one by one. It is also possible to open the auto document feeder 2 and place original documents on a document table of the image reading unit 3.

The image reading unit 3 includes a carriage including an exposure lamp that exposes an original document to light and a reflecting mirror, plural reflecting mirrors set in a main body frame of the image forming apparatus 1, a lens block, and a CCD (Charge Coupled Device) of an image reading sensor.

The carriage stands still in the document reading unit or reciprocatingly moves below the document table to reflect the light of the exposure lamp, which is reflected by the original document, to the lens block via the plural reflecting mirrors. The lens block magnifies this reflected light and outputs the reflected light to the CCD. The CCD converts the light made incident thereon into an electric signal and outputs the electric signal to the image forming unit 4 as an image signal.

The image forming unit 4 includes laser irradiating units, photoconductive drums, and toner supplying units.

The laser irradiating units irradiate laser beams on the photoconductive drums on the basis of the image signal and form electrostatic latent images on the photoconductive drums. The toner supplying units supply toner to the photoconductive drums and form toner images from the electrostatic latent images.

The paper feeding units 6 extract the recording media P from paper feeding cassettes 6*a* one by one and pass the recording medium P to the sheet conveying mechanism. The sheet conveying mechanism conveys the recording medium to the transfer mechanism 5. The transfer mechanism 5 includes a transfer belt and transfer rollers. The transfer belt as an image bearing member receives the transfer of the toner images on the photoconductive drums and bears the toner images. The transfer rollers apply voltage to the toner images on the transfer belt and transfer the toner images onto the recording medium P conveyed thereto.

The fixing unit 7 heats and presses the toner images and fixes the toner images on the recording medium P.

In the case of a simplex printing mode, the recording medium P having the toner images fixed on one side thereof is discharged through the discharging mechanism 9. In the case of a duplex printing mode, the recording medium P having the toner images fixed on one side thereof is conveyed to the image forming unit 4 via the reverse conveying mechanism 8 and toner images are formed in the same manner as explained above. Then, the recording medium P is discharged through the transfer mechanism 5, the fixing unit 7, and the discharging mechanism 9.

On the other hand, an image forming apparatus of the ink jet system is the same as the image forming apparatus of the electrophotographic system except that an ink jet recording unit is built in an image forming unit and peculiar mechanical components such as an ink supplying mechanism are provided.

Paper Feeding Unit According to a First Embodiment

Figure 2:
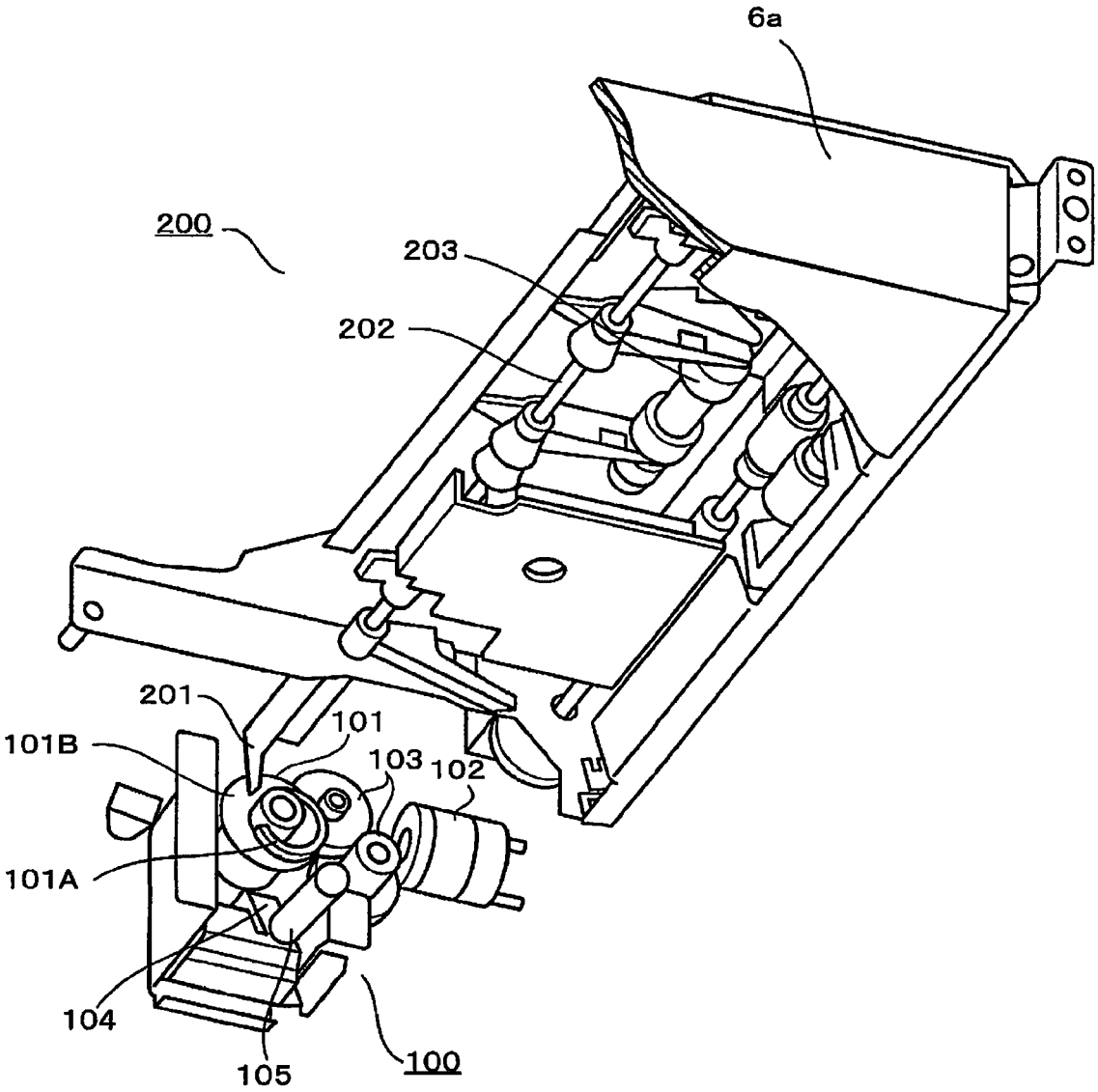
FIG. 2 is a perspective view of a main part of a paper feeding unit.

FIG. 2 is a perspective view of a main part of the paper feeding unit 6. As shown in FIG. 2, the paper feeding unit 6 includes a pickup roller lifting and lowering mechanism 200 set in the main body of the image forming apparatus 1 and a lifting and lowering driving mechanism 100.

The pickup roller lifting and lowering mechanism 200 includes a rotation lever 201, a pickup roller lifting and lowering shaft 202 that rotates in association with the rotation lever 201, and a pickup roller 203 that rises and falls according to the rotation of the pickup roller lifting and lowering shaft 202.

The lifting and lowering driving mechanisms 100 includes a driving motor 102, a deceleration gear 103 driven by the driving motor 102, and a cam gear 101 driven by the deceleration gear 103.

When the driving motor 102 rotates, the cam gear 101 rotates via the deceleration gear 103. A cam of the cam gear 101 rotates the rotation lever 201. When the rotation lever 201 rotates, the pickup roller lifting and lowering shaft 202 rotates and lowers the pickup roller 203.

Figure 3:
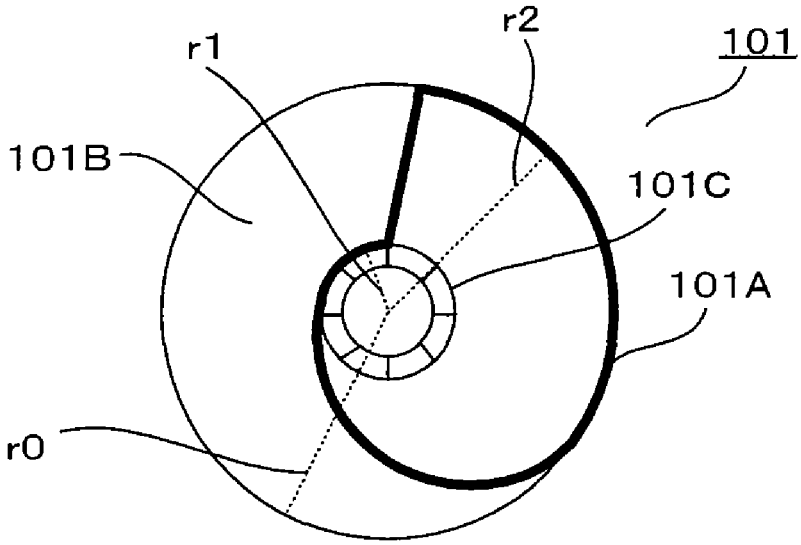
FIG. 3 is a front view of a cam gear.

FIG. 3 is a front view of the cam gear 101. As shown in FIG. 3, the cam gear 101 has a base disc 101B, which is a disc perpendicular to a rotation axis, and a cam 101A set in contact with the base disc 101B.

The cam 101A is formed such that the radius thereof increases as an angle increases toward a rotating direction. A minimum radius r1 of the cam 101A is the same as the radius of a center cylinder 101C provided in the center of the cam gear 101. A maximum radius r2 of the cam 101A is the same as a radius r0 of the base disc 101B. A central angle at which the radius of the cam 101A is maximized is equal to or larger than 90° and equal to or smaller than 120°. An external shape of the cam 101A smoothly continues from the portion of the minimum radius r1 to the portion of the maximum radius 2*r*.

Figure 4:
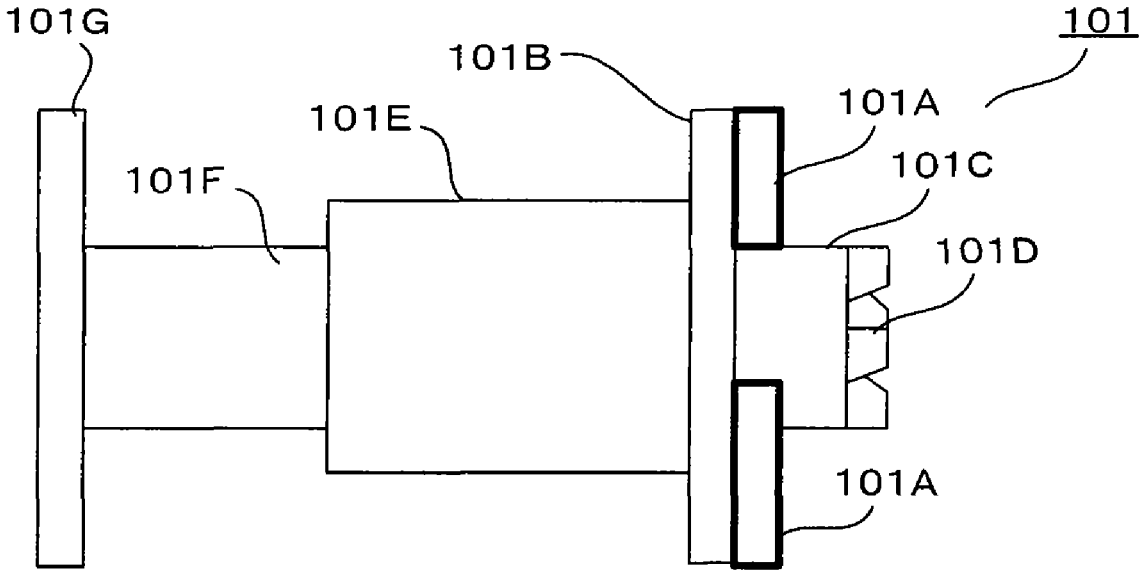
FIG. 4 is a side view of the cam gear.

FIG. 4 is a side view of the cam gear 101. As shown in FIG. 4, the cam gear 101 has a pressing disc 101G, a cylindrical section 101F, a gear section 101E, the base disc 101B, the cam 101A, the center cylinder 101C, and a fitting section 101D.

The pressing disc 101G is made of a disc perpendicular to the rotation axis of the cam gear 101. The diameter of the pressing disc 101G is larger than that of the cylindrical section 101F.

The diameter of the cylindrical section 101F is smaller than those of the pressing disc 101G and the gear section 101E. The gear section 101E has teeth of a toothed gear on the surface thereof. In FIG. 4, the teeth are not shown. The diameter of the gear section 101E is larger than that of the cylindrical section 101F and smaller than that of the base disc 101B.

The diameter of the center cylinder 101C is smaller than that of the base disc 101B. The center cylinder 101C has the fitting section 101D at an end thereof. The fitting section 101D includes plural teeth having tooth surfaces, one sides of which vertically rise up and the other sides of which incline.

Figure 5:
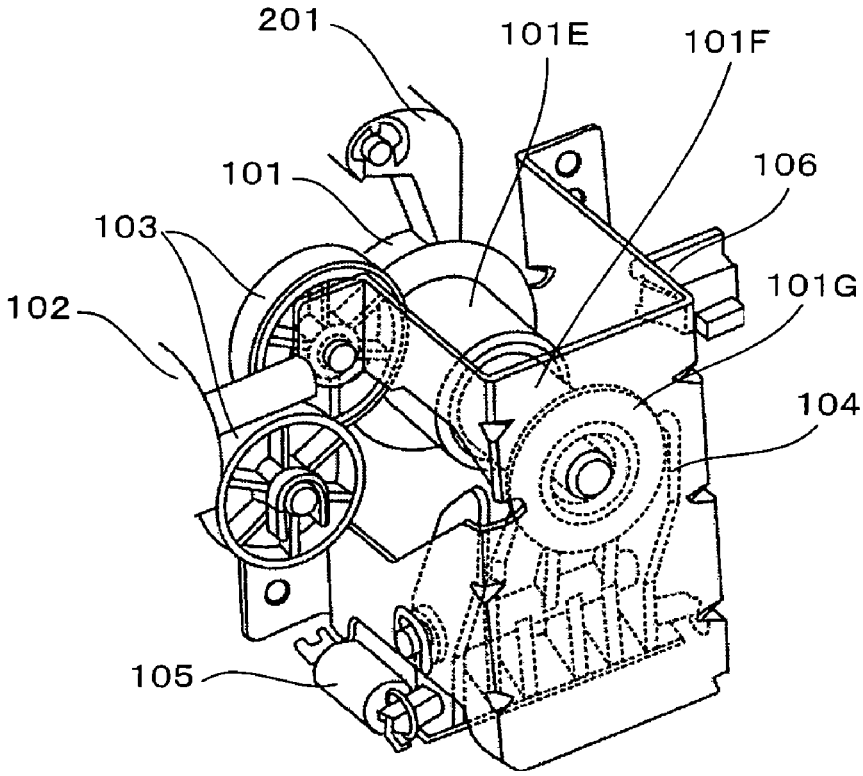
FIG. 5 is a rear perspective view of a lifting and lowering driving mechanism.
Figure 6:
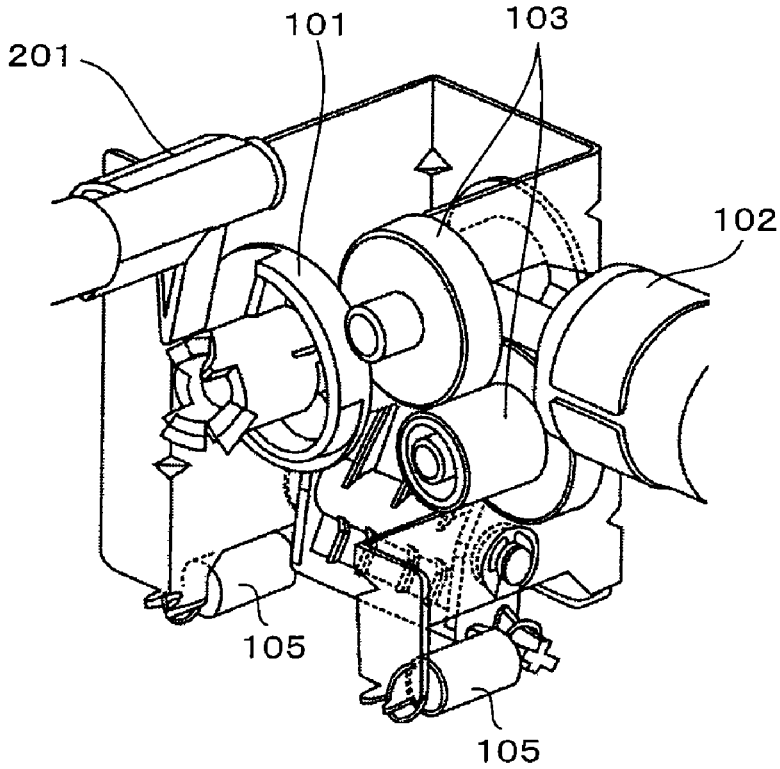
FIG. 6 is a front perspective view of the lifting and lowering driving mechanism.

FIG. 5 is a rear perspective view of the lifting and lowering driving mechanism 100. FIG. 6 is a front perspective view of the lifting and lowering driving mechanism 100. As shown in FIGS. 5 and 6, the lifting and lowering driving mechanism 100 rotatably supports the cam gear 101 in a lifting and lowering driving mechanism frame 106.

The lifting and lowering driving mechanism 100 pivotally supports a pair of push-back levers 104, which are push-back mechanisms, in the lifting and lowering driving mechanism frame 106. A space between the push-back levers 104 is narrower than the pressing disc 101G. One ends of the push-back levers 104 are arranged between the gear section 101E and the pressing disc 101G to hold the cylindrical section 101F.

Elastic members such as tension springs 105 are provided at the other ends of the push-back levers 104. The tension springs 105 urge the push-back levers 104 in a direction in which the push-back levers 104 push the pressing disc 101G.

An elastic member such as a compression spring (not shown) is provided in the inside of the cam gear 101. The compression spring urges to push the cam gear 101 in the direction of the rotation lever 201, i.e., a direction opposite to the inserting direction of the paper feeding cassette 6*a*. The force of the tension springs 105 is stronger than the force of the compression spring.

Figure 7:
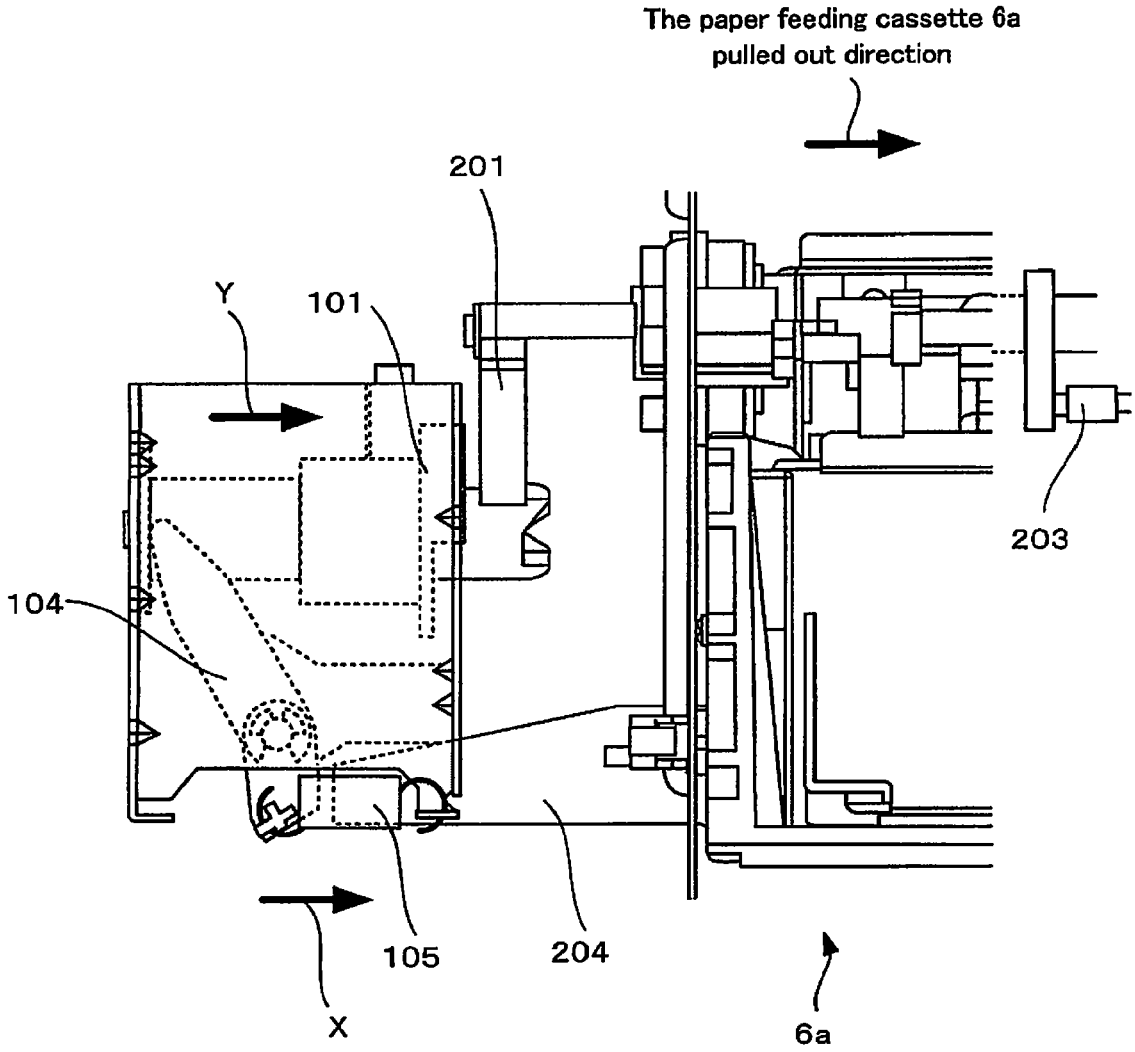
FIG. 7 is a side view of the lifting and lowering driving mechanism immediately before a paper feeding cassette is inserted.
Figure 7:
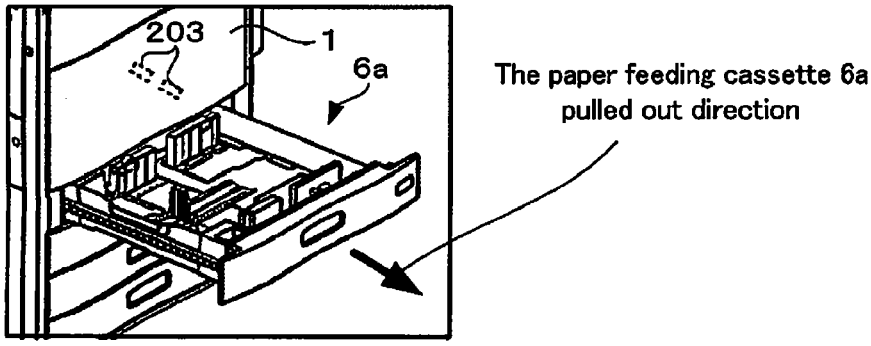

FIG. 7 is a side view of the lifting and lowering driving mechanism 100 before the paper feeding cassette 6*a* is inserted. As shown in FIG. 7, the tension spring 105 pulls one end of the push-back lever 104 in an arrow X direction. The compression spring in the inside of the cam gear 101 pushes the cam gear 101 in an arrow Y direction. The force of the tension spring 105 for pulling the push-back lever 104 is stronger than the force of the compression spring for pushing the cam gear 101. Therefore, the cam gear 101 is pushed to a position set in contact with the lifting and lowering driving mechanism frame 106 and is stopped. The cam gear 101 is separated from the rotation lever 201.

Figure 8:
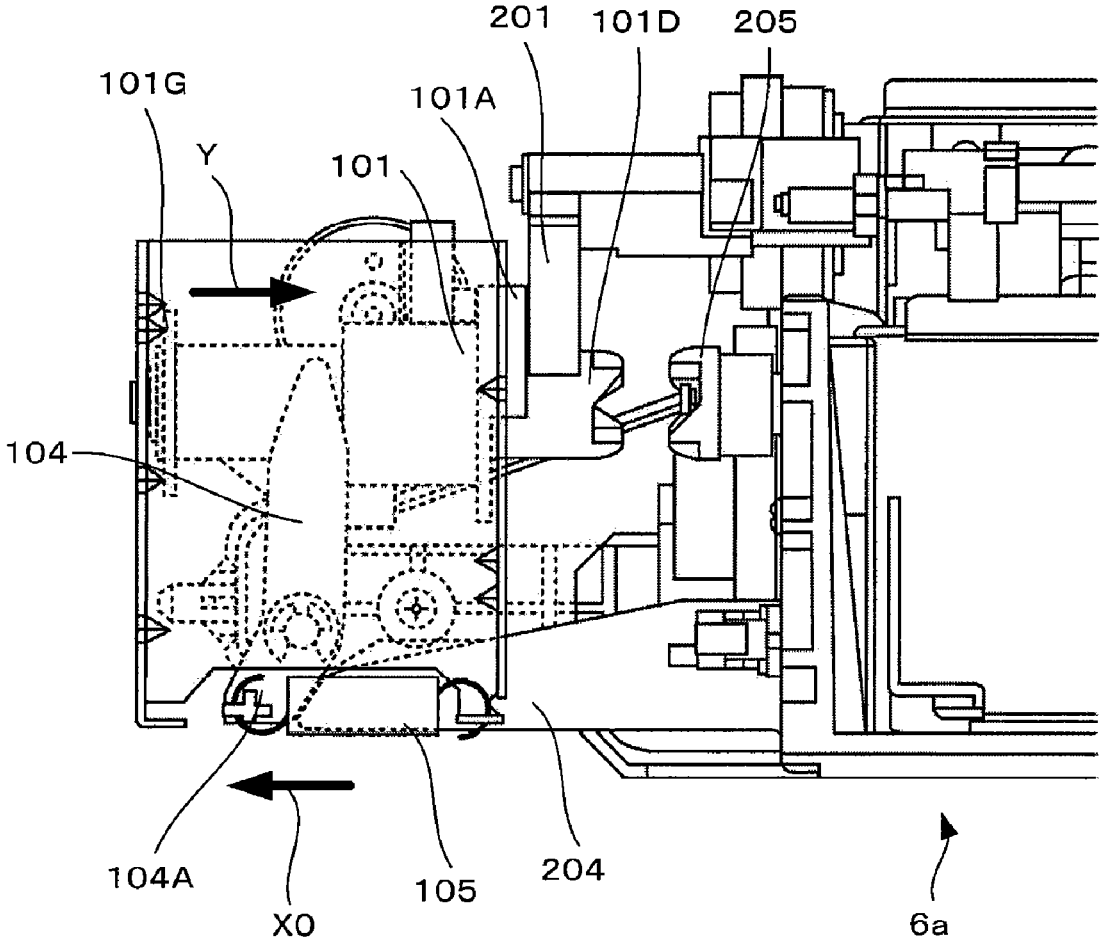
FIG. 8 is a side view of the lifting and lowering driving mechanism at the start of the insertion of the paper feeding cassette.

FIG. 8 is a side view of the lifting and lowering driving mechanism 100 at the start of the insertion of the paper feeding cassette 6*a*. As shown in FIG. 8, the distal end of a pressing projection 204 of the paper feeding cassette 6*a* pushes a pressure receiving section 104A, which is one end to which the tension spring 105 of the push-back lever 104 is attached, in an arrow X0 direction. At the same time, an insertion sensor (not shown) that detects the insertion of the paper feeding cassette 6*a* detects the insertion of the paper feeding cassette 6*a*.

When the pressing projection 204 pushes the pressure receiving section 104A, the push-back lever 104 separates from the pressing disc 101G. When the push-back lever 104 separates from the pressing disc 101G, the cam gear 101 is moved in the arrow Y direction by the compression spring. However, the cam 101A comes into contact with the rotation lever 201. The fitting section 101D does not fit with a cassette-side fitting section 205.

Figure 9:
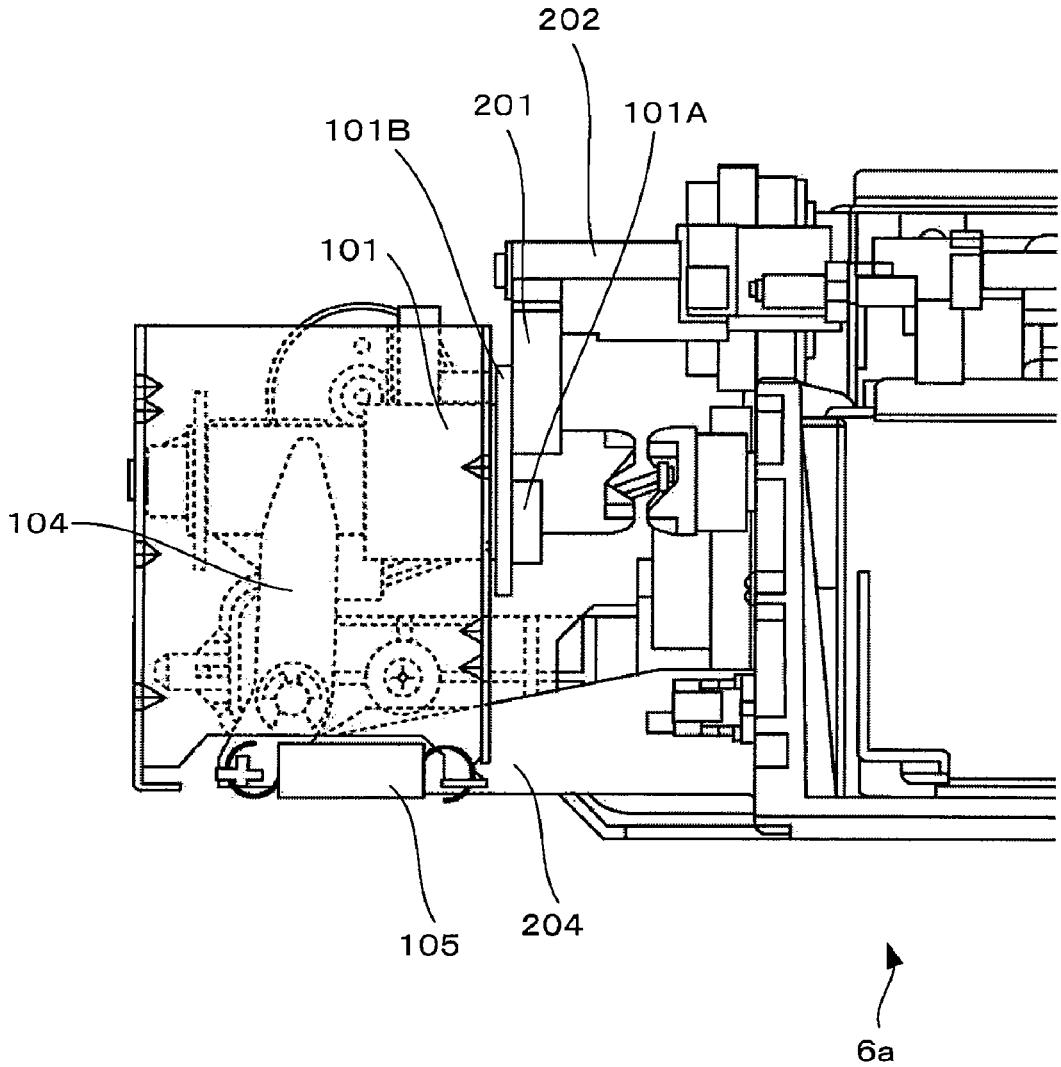
FIG. 9 is a side view of the lifting and lowering driving mechanism immediately after a cam gear thereof starts rotation.

FIG. 9 is a side view of the lifting and lowering driving mechanism 100 immediately after the cam gear 101 starts rotation. As shown in FIG. 9, when the insertion sensor detects the insertion of the paper feeding cassette 6*a*, the driving motor 102 is driven to rotate the cam gear 101.

When the cam gear 101 rotates, the rotation lever 201 enters a portion where the radius of the cam 101A is smaller than that of the base disc 101B. The cam gear 101 moves in the direction of the rotation lever 201 by the thickness of the cam 101A. The rotation lever 201 does not rotate yet.

Figure 10:
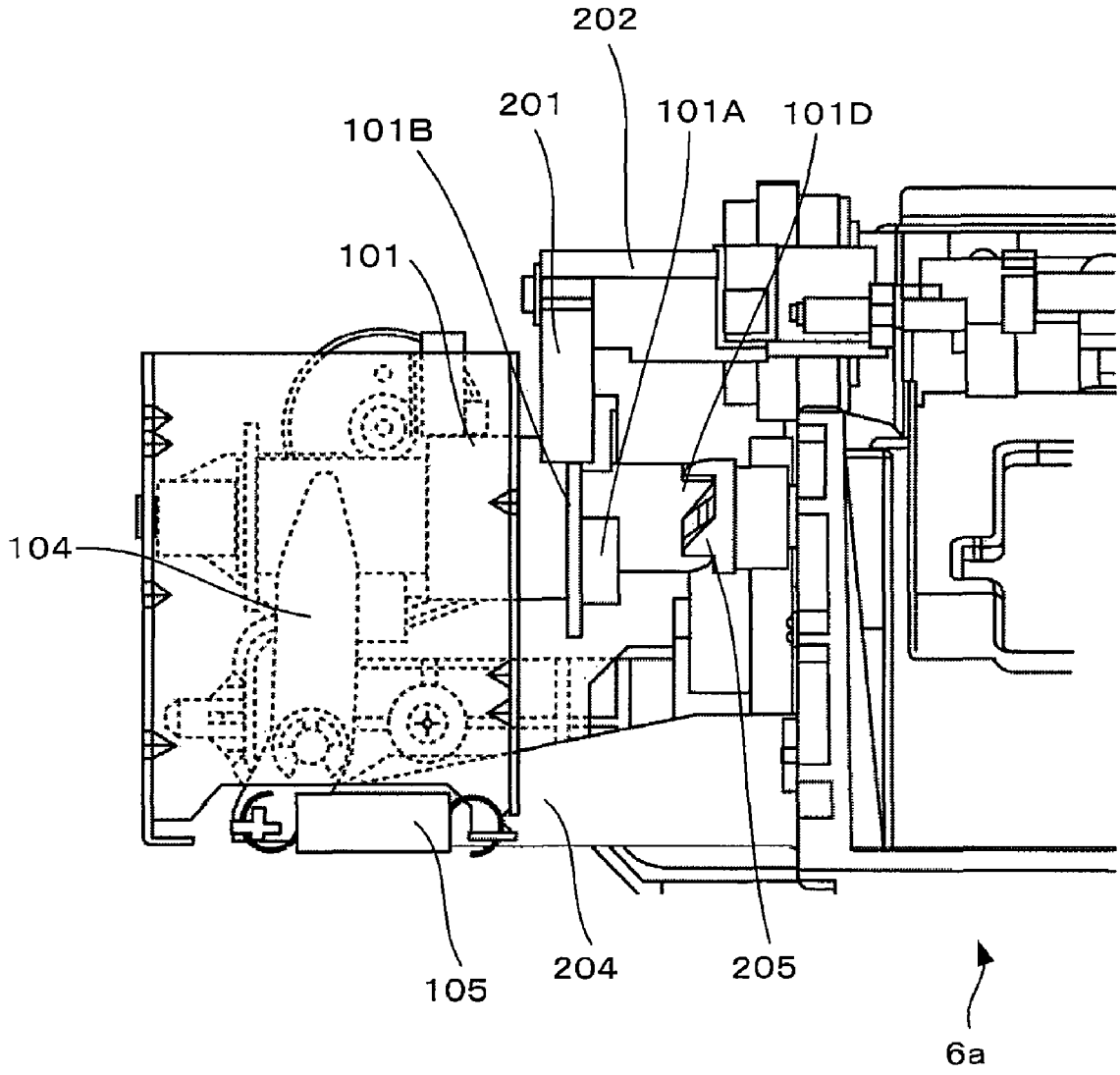
FIG. 10 is a side view of the lifting and lowering driving mechanism during the rotation of the cam gear.

FIG. 10 is a side view of the lifting and lowering driving mechanism 100 during the rotation of the cam gear 101. As shown in FIG. 10, the cam 101A rotates the rotation lever 201. When the rotation lever 201 approaches a portion where the radius of the cam 101A is equal to the radius of the base disc 101B, the cam gear 101 further moves in the direction of the rotation lever 201. The fitting section 101D and the cassette-side fitting section 205 fit with each other.

When the fitting section 101D and the cassette-side fitting section 205 fit with each other, the rotation lever 201 is pushed up to the circumference of the base disc 101B by the rotation of the cam 101A and rotates. The rotation lever 201 rotates the pickup roller lifting and lowering shaft 202. The pickup roller lifting and lowering shaft 202 drives a driving belt 209. The pickup roller 203 falls.

In a cassette side frame, a cassette-side fitting section 205 rotatably supported by the cassette side frame, a deceleration gear 206, a semicircular gear 207, and a tray-up shaft 208 are set.

The rotation of the cam gear 101 is transmitted to the cassette-side fitting section 205 via the fitting section 101D. A rotation gear 205A of the cassette-side fitting section 205 rotates the deceleration gear 206. The deceleration gear 206 rotates the semicircular gear 207. The semicircular gear 207 rotates the tray-up shaft 208. The tray-up shaft 208 drives a tray lifting and lowering member (hereinafter referred to as tray lift 210) coupled thereto.

Figure 11:
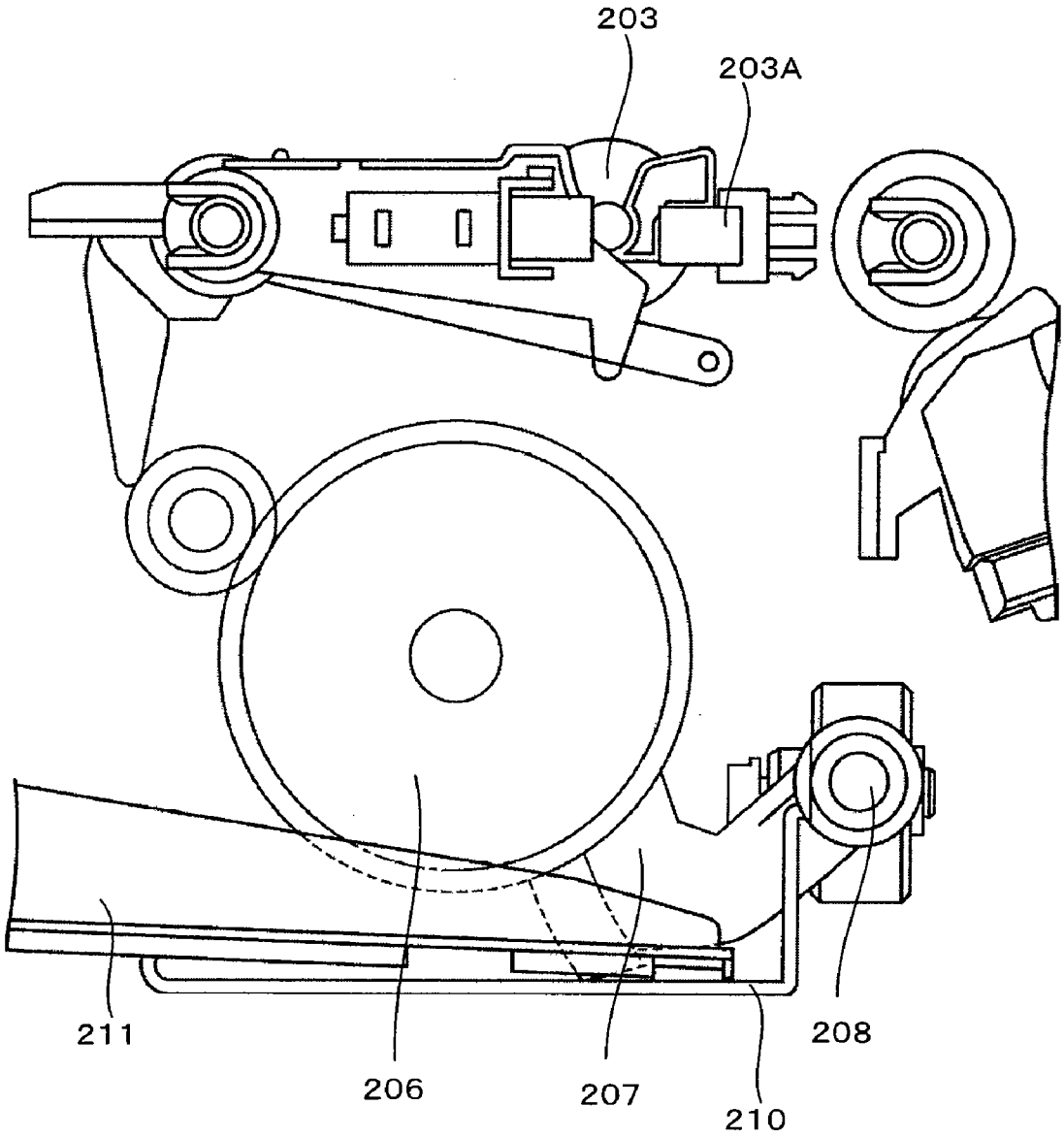
FIG. 11 is a side view of a state before a tray lift is driven.

FIG. 11 is a side view of a state before the tray lift 210 is driven. As shown in FIG. 11, the tray lift 210 is coupled to the tray-up shaft 208 and pushed down by the weight of a stacking tray 211 in which recording media are stacked.

Figure 12:
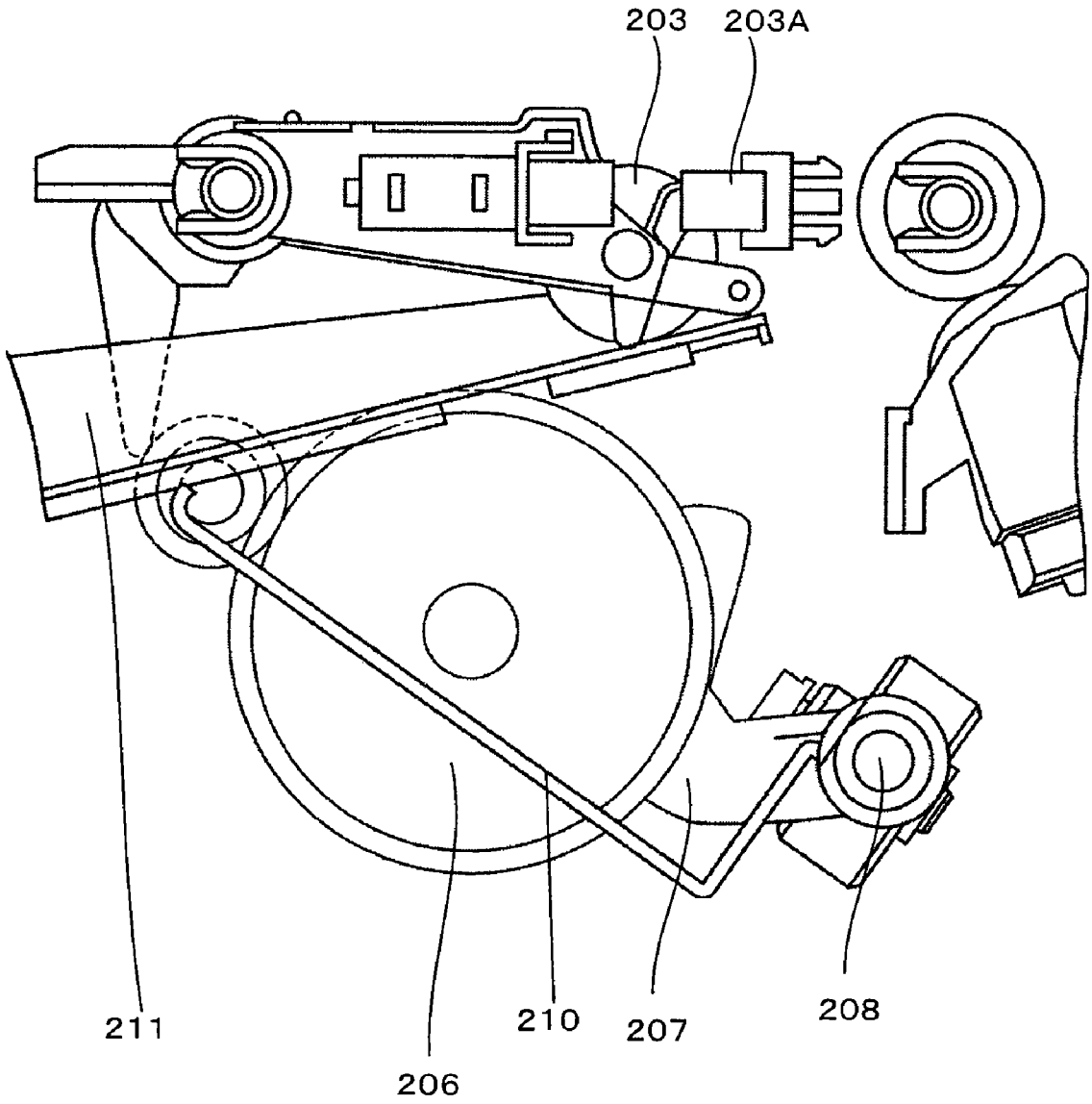
FIG. 12 is a side view of a state after the tray lift is driven.

FIG. 12 is a side view of a state after the tray lift 210 is driven. As shown in FIG. 12, the deceleration gear 206 pivots the semicircular gear 207. The semicircular gear 207 rotates the tray-up shaft 208.

The tray-up shaft 208 drives the tray lift 210. The tray lift 210 lifts the stacking tray 211.

Figure 13:
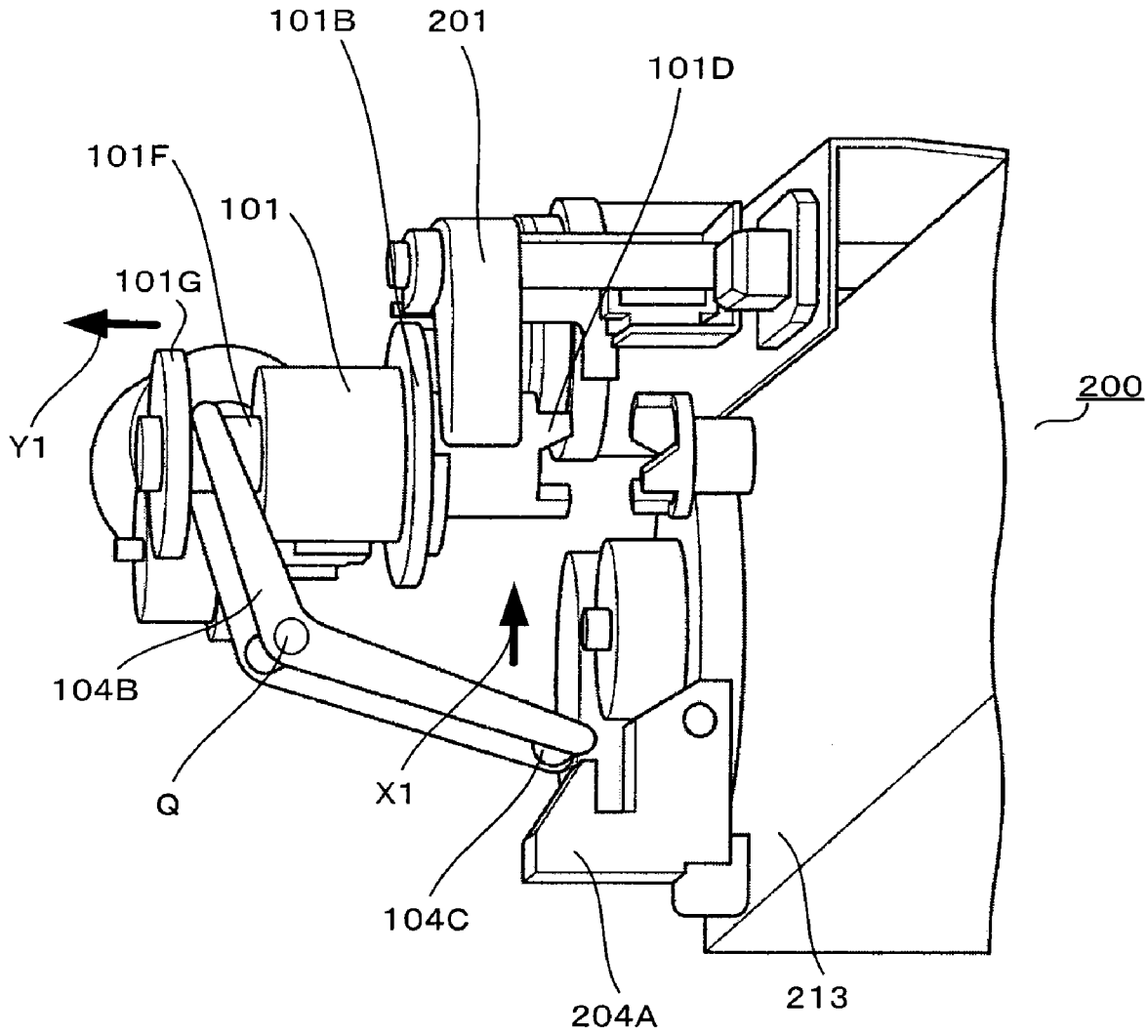
FIG. 13 is a diagram of an application example of a push-back mechanism.

FIG. 13 is a diagram of an application example of the push-back mechanism. As shown in FIG. 13, a pair of push-back arms 104B according to the application example of the push-back mechanism are arranged to hold the cylindrical section 101F such that one ends thereof push the pressing disc 101G in an arrow Y1 direction.

The push-back arms 104B are supported by a fulcrum Q to be pivotable in the lifting and lowering driving mechanism frame 106. The push-back arms 104B bend to the cam gear 101 side at the fulcrum Q. The push-back arms 104B have push-up pins 104C at the other ends thereof.

A hook 204A as an application example of the pressing projection 204 is provided in a frame 213 on the paper feeding cassette 6*a* side. When the paper feeding cassette 6*a* is inserted, the hook 204A pushes up the push-up pins 104C in an arrow X1 direction.

When the push-up pins 104C are pushed up, the push-back arms 104B pivot and press the pressing disc 101G. The cam gear 101 moves in the arrow Y1 direction.

Figure 14:
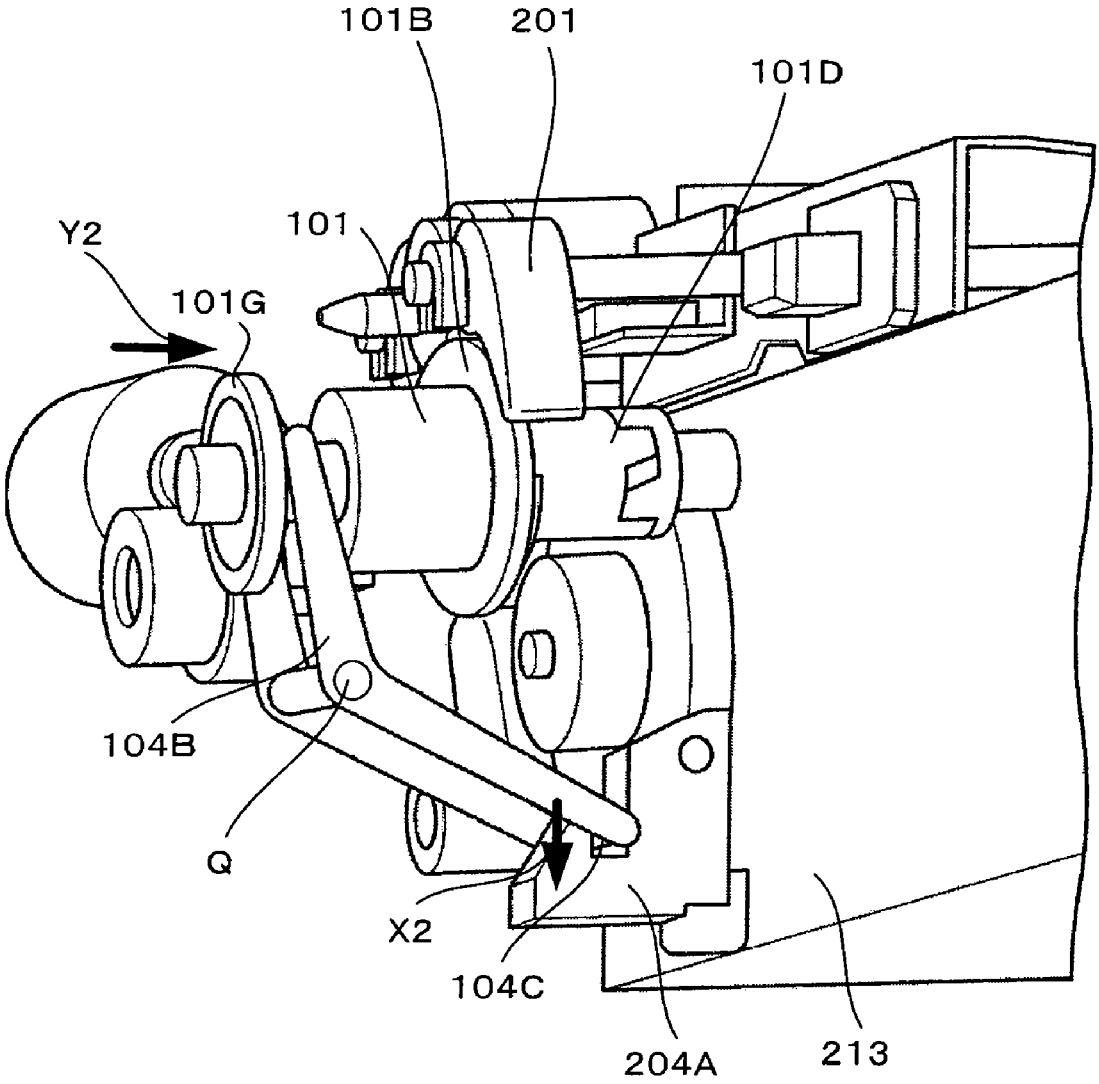
FIG. 14 is a perspective view of a push-back arm at the time of the insertion of the paper feeding cassette.

FIG. 14 is a perspective view of the push-back arms 104B at the time of the insertion of the paper feeding cassette 6*a*. As shown in FIG. 14, the push-up pins 104C fit in the hook 204A when the paper feeding cassette 6*a* is inserted. When the push-up pins 104C fit in the hook 204A, one ends of the push-back arms 104B move in an arrow X2 direction. The other ends of the push-back arms 104B move in an arrow Y2 direction. The cam gear 101 is moved in the arrow Y2 direction by the compression spring.

The cam gear 101 rotates and the cam 101A rotates the rotation lever 201. When the rotation lever 201 approaches a portion where the radius of the cam 101A is equal to the radius of the base disc 101B, the cam gear 101 further moves in the direction of the rotation lever 201. The fitting section 101D and the cassette-side fitting section 205 fit with each other.

Load Sensor

Figure 15:
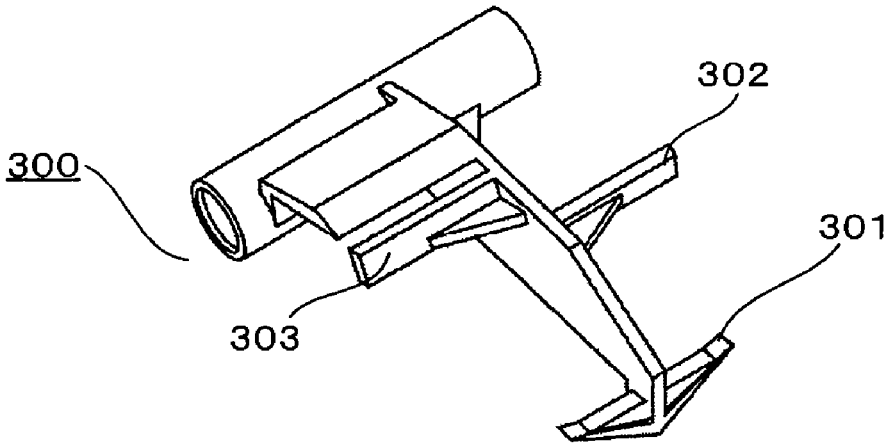
FIG. 15 is a perspective view of a load actuator that is an actuator of a load sensor.

FIG. 15 is a perspective view of a load actuator 300 that is an actuator of a load sensor. As shown in FIG. 15, the load actuator 300 has an arrow-shaped load detecting section 301 at the distal end thereof and has a driving projection 302 and a first screening member (projection 303) for proper load detection in the center of an arm section.

Figure 16:
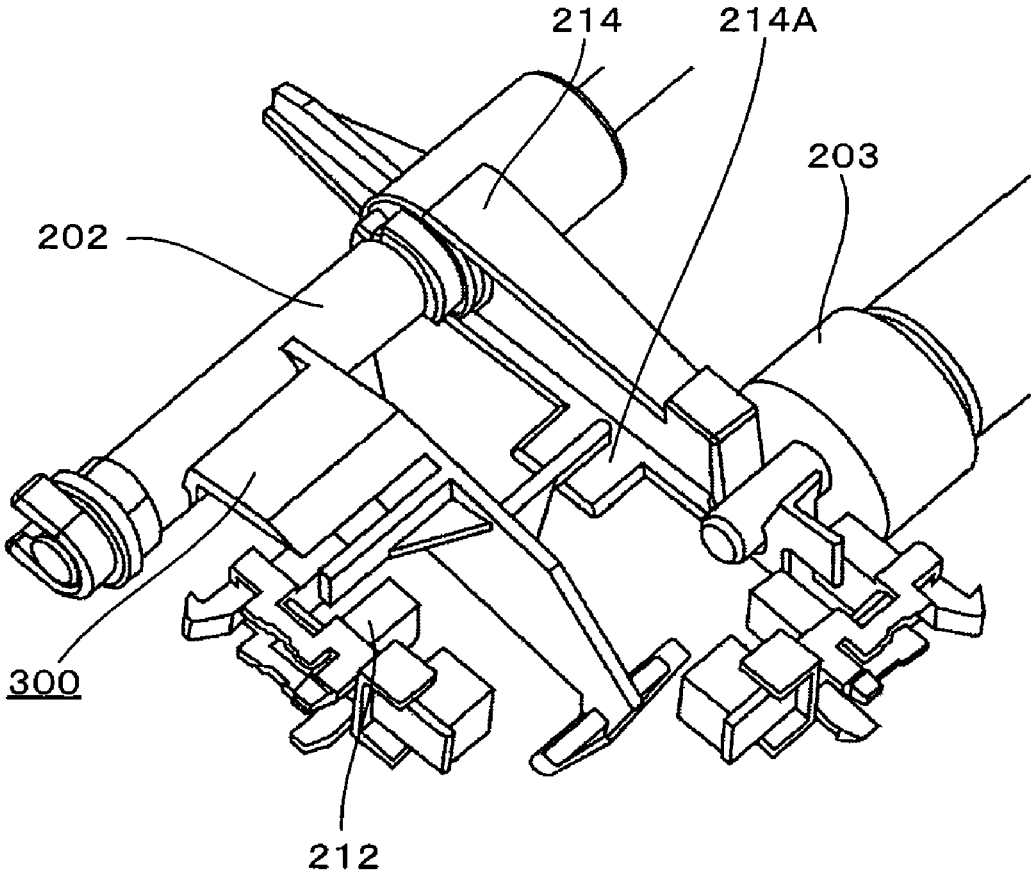
FIG. 16 is a perspective view of the load actuator and the load sensor.

FIG. 16 is a perspective view of the load actuator 300 and a load sensor 212. As shown in FIG. 16, the load actuator 300 is pivotably attached to the pickup roller lifting and lowering shaft 202.

The driving projection 302 is placed on a supporting projection 214A provided in a pickup roller supporting arm 214. The load sensor 212 is arranged in a position where the first screening projection 303 interrupts an optical path.

Figure 17:
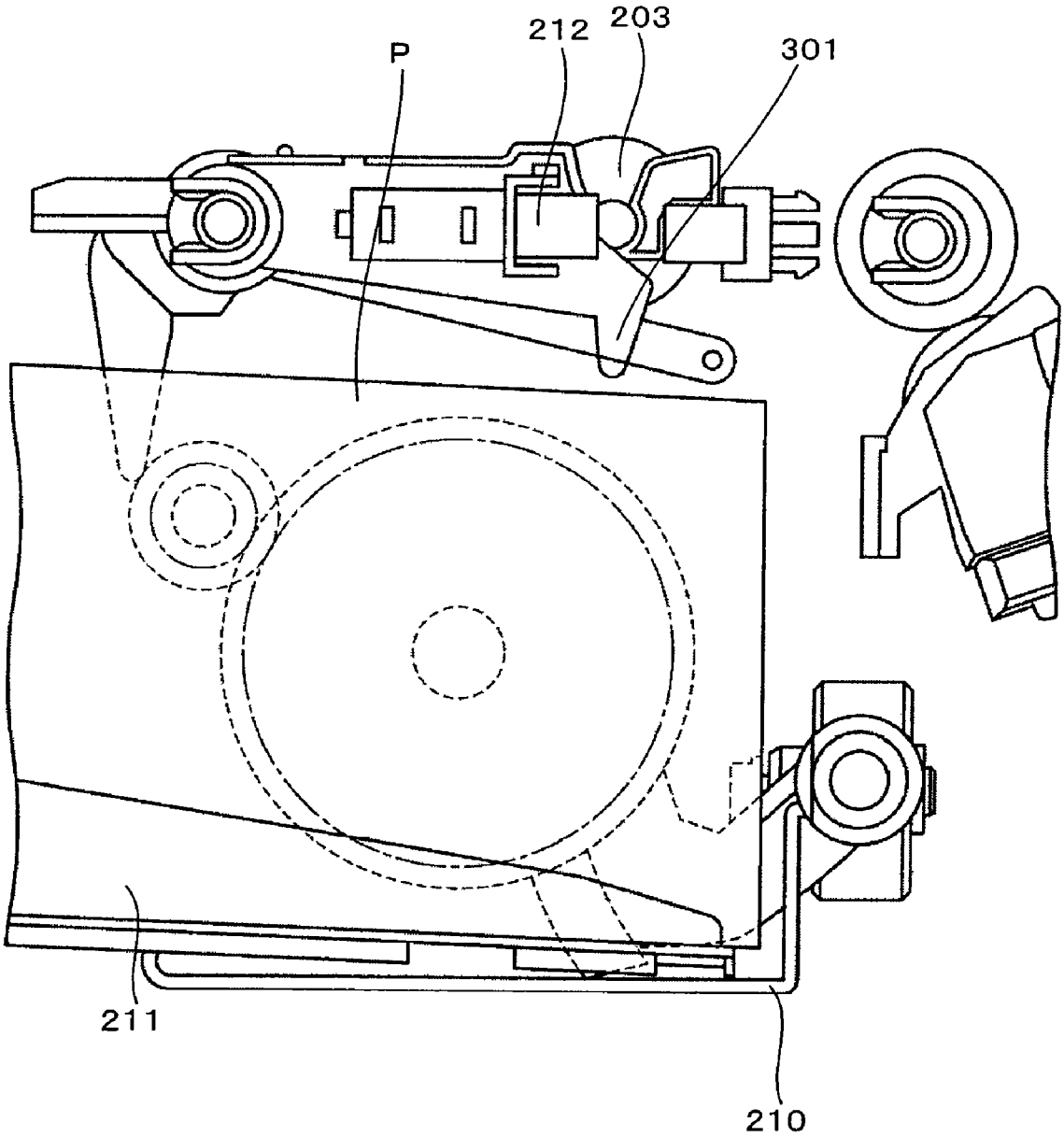
FIG. 17 is a perspective view of a state immediately after recording media P are stacked in the paper feeding cassette and the paper feeding cassette is inserted.

FIG. 17 is a perspective view of a state immediately after the recording media P are stacked in the paper feeding cassette 6*a* and the paper feeding cassette 6*a* is inserted. When a load of the recording media P is proper, the load detecting section 310 does not come into contact with the recording media P. Therefore, the first screening projection 303 turns off the load sensor 212. A pickup roller detection sensor 203A is turned on only when the pickup roller 203 passes.

Figure 18:
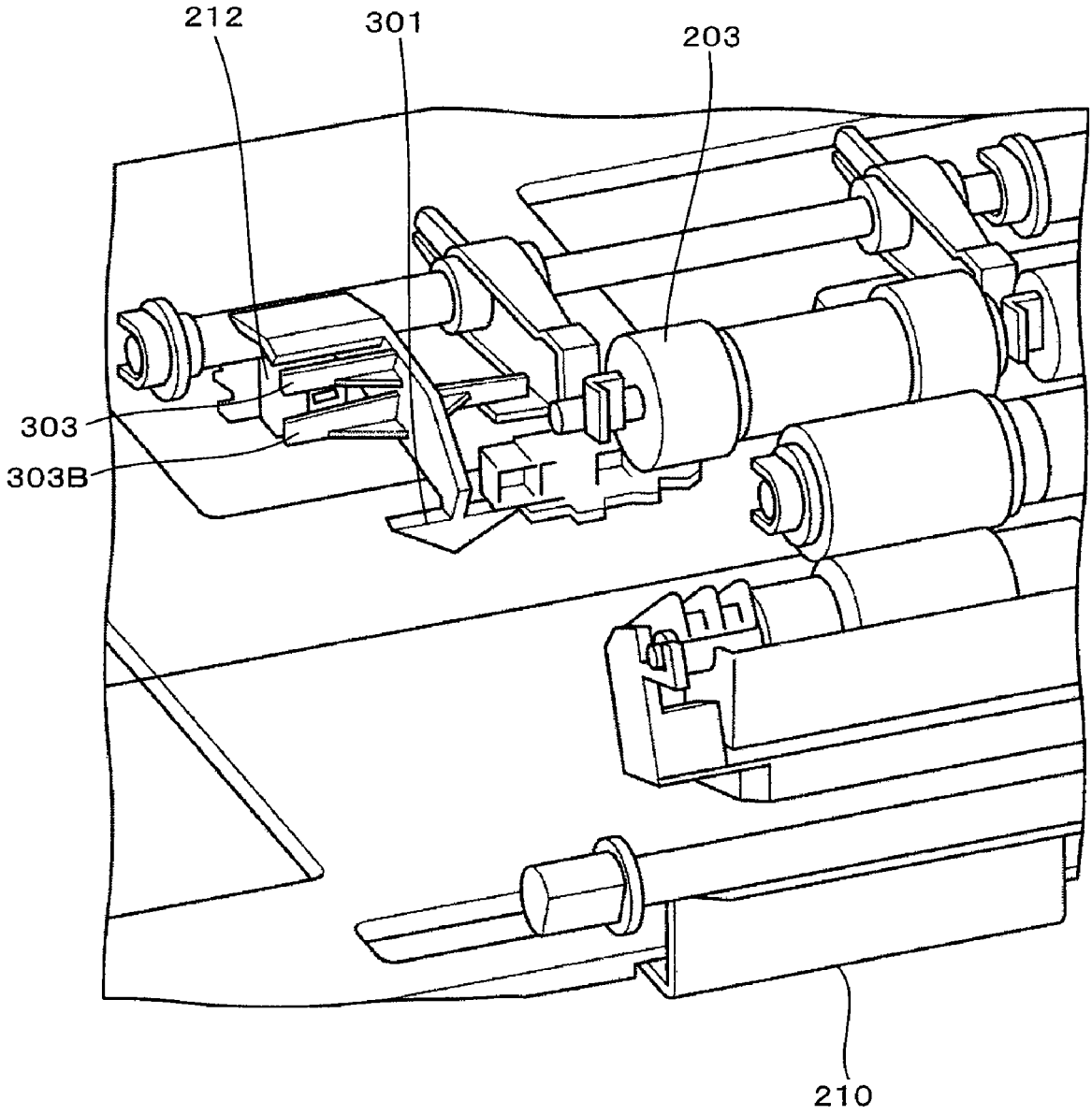
FIG. 18 is a diagram of a load actuator including a screening projection for overload detection.

FIG. 18 is a diagram of the load actuator 300 including a second screening member (projection 303B) for overload detection. As shown in FIG. 18, the second screening projection 303B is provided below the first screening projection 303 in the center of the arm section of the load actuator 300.

A state in the case of a proper load of recording media is shown in FIG. 18. As shown in FIG. 18, the first screening projection 303 and the second screening projection 303B do not interrupt the light of the load sensor 212. The load sensor 212 is turned off.

Figure 19:
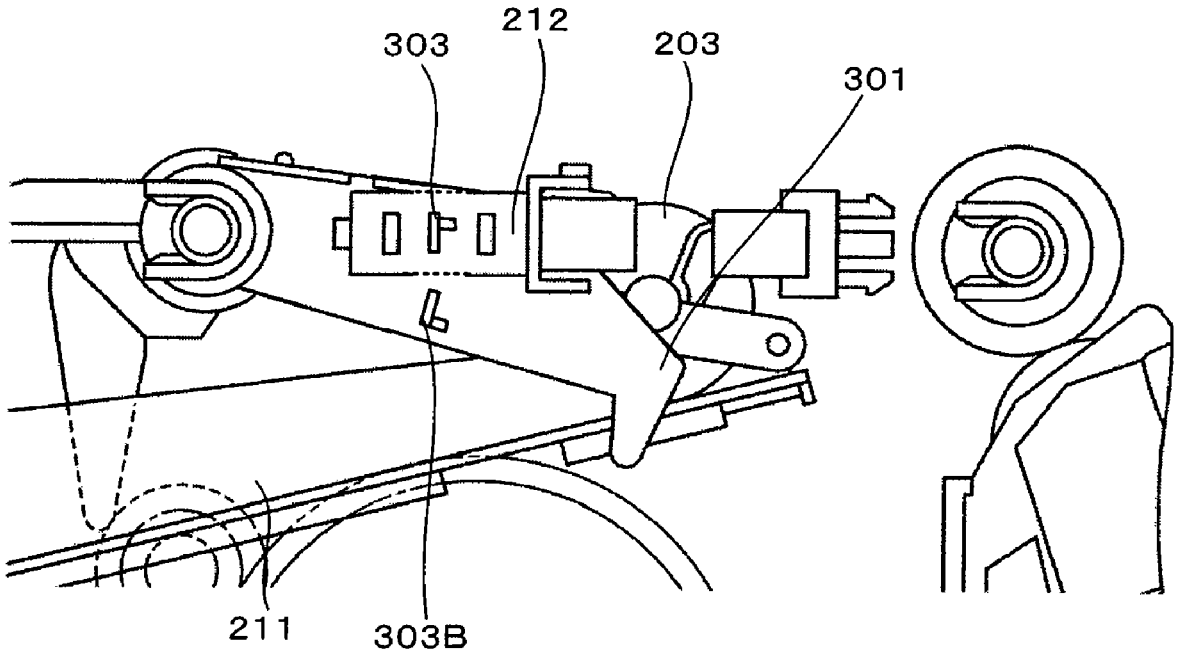
FIG. 19 is a side view of an empty state of the paper feeding cassette.
Figure 20:
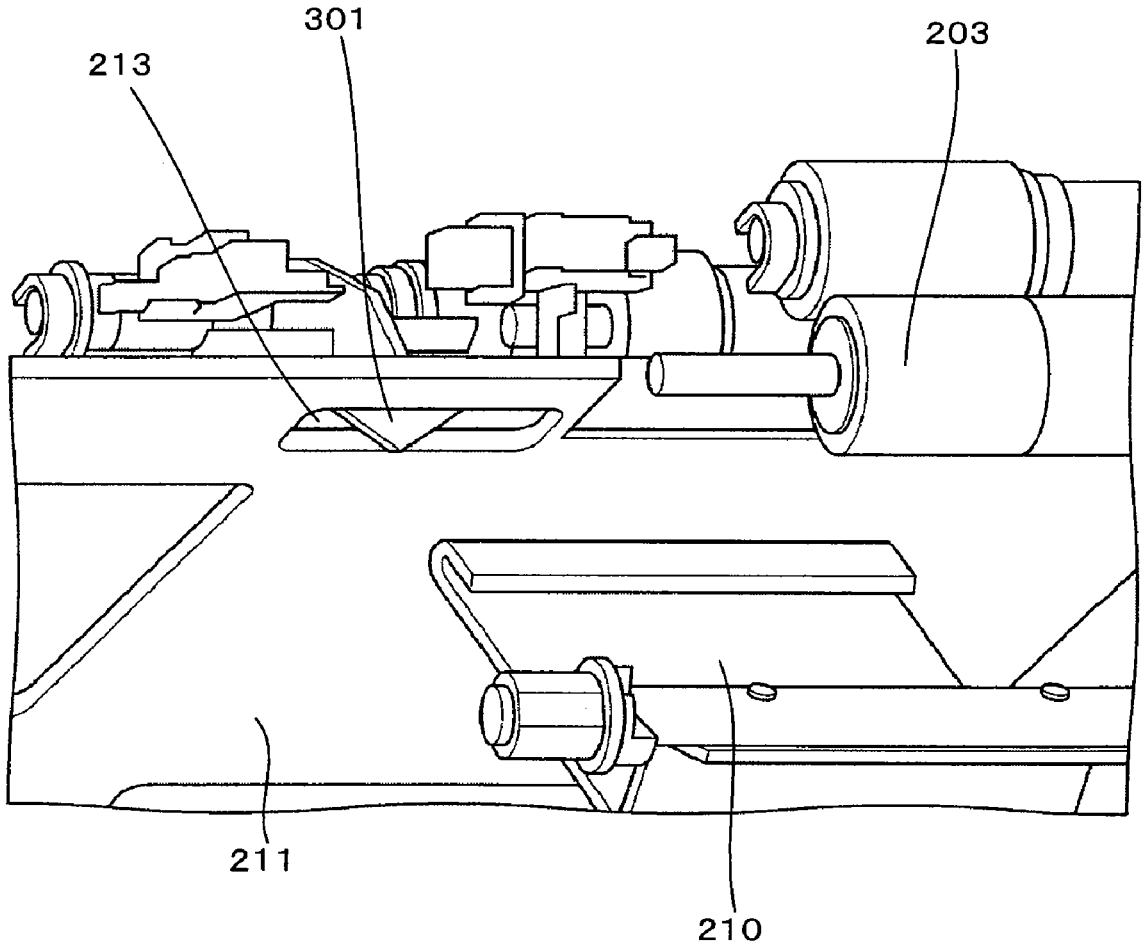
FIG. 20 is a perspective view of the empty state of the paper feeding cassette viewed from below.

FIG. 19 is a side view of an empty state of the paper feeding cassette 6*a*. As shown in FIG. 19, even if the stacking tray 211 rises, the load detecting section 301 is not lifted. Therefore, the load sensor 212 is turned on by the first screening projection 303. FIG. 20 is a perspective view of the empty state of the paper feeding cassette 6*a* viewed from below. As shown in FIG. 20, in the stacking tray 211, a no-sheet detection hole 213 is provided in a position where the load detecting section 301 falls. Therefore, when at least one recording medium P is present, the load detecting section 301 is lifted and the load sensor 212 is turned off.

Figure 21:
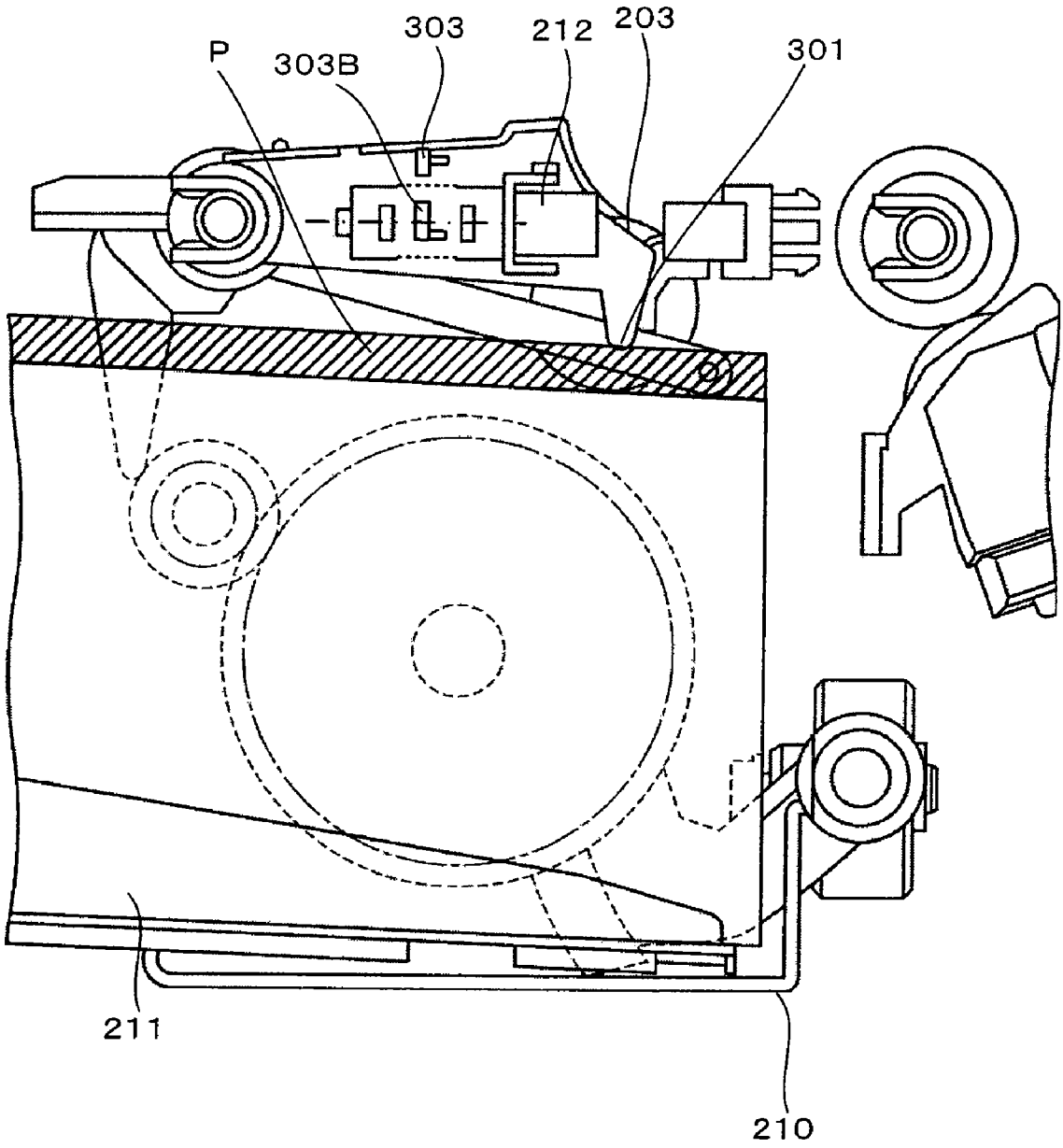
FIG. 21 is a side view of a full state of the paper feeding cassette.

FIG. 21 is a side view of a full state of the paper feeding cassette 6*a*. As shown in FIG. 21, even if the pickup roller 203 falls, the pickup roller detection sensor 203A is kept off. The load sensor 212 is turned on by screening projection 303.

Figure 22:
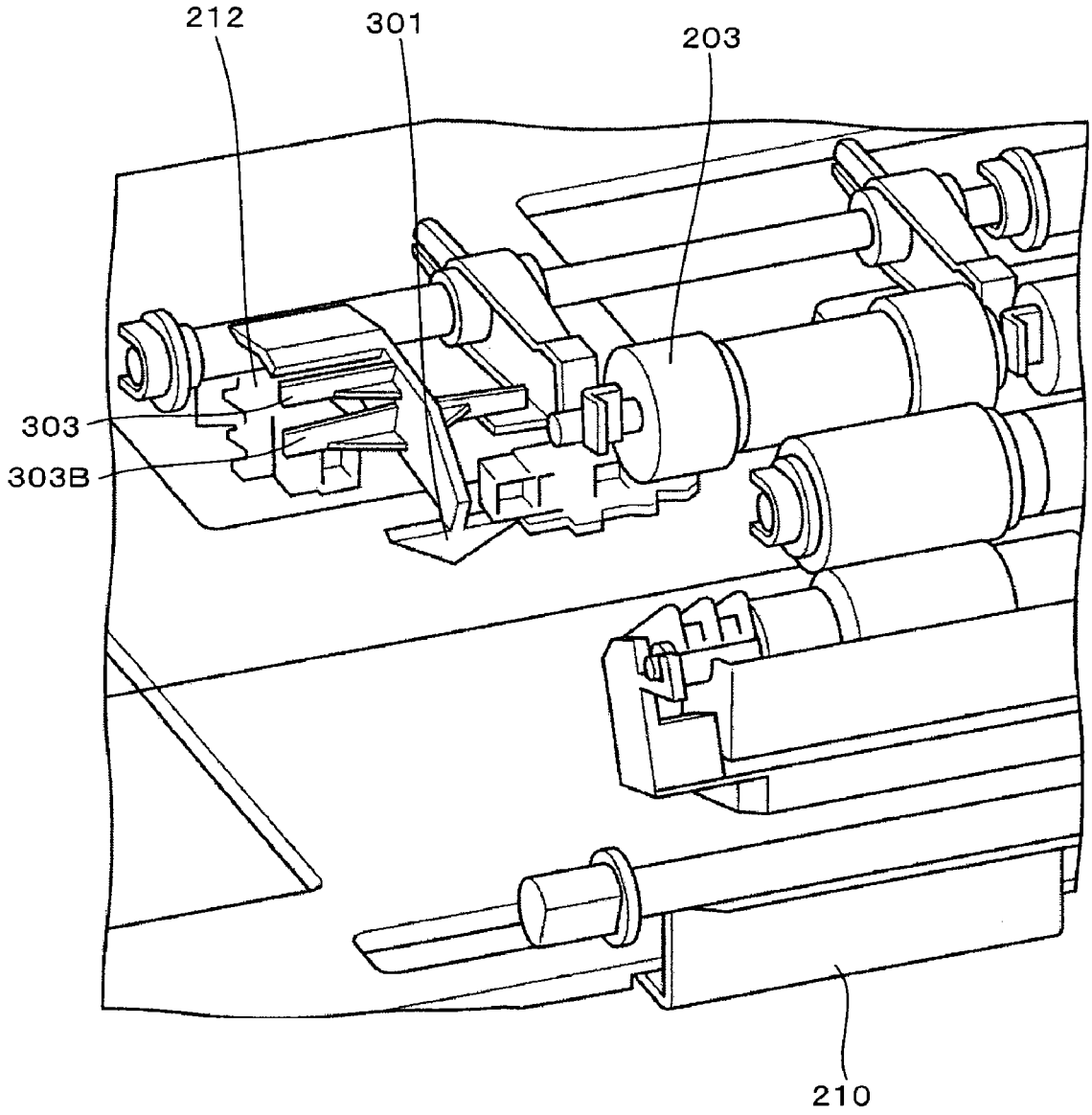
FIG. 22 is a perspective view of an overload state of the paper feeding cassette.

FIG. 22 is a perspective view of an overload state of the paper feeding cassette 6*a*. As shown in FIG. 22, when the paper feeding cassette 6*a* is overloaded, the second screening projection 303B turns on the load sensor 212.

Control of a Tray-Up Operation

The driving motor 102 is controlled as explained below in order to perform tray-up operation that is operation for lifting the stacking tray 211.

When an Overload is not Detected (1) When the paper feeding cassette 6*a* is inserted in the main body of the image forming apparatus 1, the insertion sensor is turned on.

(2) After several tens ms, when the pickup roller detection sensor 203A is off (does not interrupt) and the load sensor 212 is off (does not interrupt), the driving motor 102 is driven.

(3) When the driving motor 102 is driven, the pickup roller 203 starts to fall from an uppermost position to turn on the pickup roller detection sensor 203A shown in FIG. 11 for an instance and turn off the pickup roller detection sensor 203A again. When the pickup roller detection sensor 203A is not turned off, processing at abnormal time such as error display is started.

When the pickup roller detection sensor 203A is turned on, the driving motor 102 stops for a predetermined time. This predetermined time is time sufficient for the pickup roller 203 to fall and pass the pickup roller detection sensor 203A.

After the predetermined time elapses, it is checked again whether the pickup roller detection sensor 203A is on or off. When the insertion sensor is turned off, the processing at abnormal time is started.

(4)

(a) When the pickup roller detection sensor 203A is off, the driving motor 102 is driven until the pickup roller detection sensor 203A is turned on.

(b) When the pickup roller detection sensor 203A is on, the tray-up operation is finished.

When an Overload is Detected (1) When the paper feeding cassette 6*a* is inserted in the main body of the image forming apparatus 1, the insertion sensor is turned on.

(2) After several tens ms, when the pickup roller detection sensor 203A is off (does not interrupt) and the load sensor 212 is off (does not interrupt), the driving motor 102 is driven.

When the pickup roller detection sensor 203A is off and the load sensor 212 is on, an alarm indicating an overload is emitted. The alarm is performed by means of voice, display on a control panel, or the like.

(3) When the driving motor 102 is driven, the pickup roller 203 starts to fall from the uppermost position to turn on the pickup roller detection sensor 203A shown in FIG. 11 for an instance and turn off the pickup roller detection sensor 203A again. When the pickup roller detection sensor 203A is not turned off, the processing at abnormal time is started.

When the pickup roller detection sensor 203A is turned on, the driving motor 102 stops for a predetermined time. This predetermined time is time sufficient for the pickup roller 203 to fall and pass the pickup roller detection sensor 203A.

After the predetermined time elapses, it is checked again whether the pickup roller detection sensor 203A is on or off. When the insertion sensor is turned off, the processing at abnormal time is started.

(4)

(a) When the pickup roller detection sensor 203A is off, the driving motor 102 is driven until the pickup roller detection sensor 203A is turned on.

(b) When the pickup roller detection sensor 203A is on, the tray-up operation is finished.

Effect of this Embodiment

As explained above, the pickup roller lifting and lowering mechanism and the image forming apparatus including the lifting and lowering mechanism according to this embodiment includes the lifting and lowering mechanism 100 including the cam gear 101, which includes the cam 101A, the base disc 101B, the pressing disc 101G, and the compression spring, and the push-back levers 104, which includes the tension springs 105, and the pickup roller lifting and lowering mechanism 200 including the pressing projection 204 and the rotation lever 201 that lowers the pickup roller 203.

The pickup roller lifting and lowering mechanism and the image forming apparatus including the lifting and lowering mechanism according to this embodiment lift the stacking tray 211 awaiting the elapse of time from the time when the pickup roller 203 starts to fall until the pickup roller 203 completely falls.

Therefore, there is an effect that the pickup roller lifting and lowering mechanism and the image forming apparatus including the lifting and lowering mechanism according to this embodiment can lower the pickup roller 203 after the paper feeding cassette 6*a* is completely inserted and the height of the paper feeding cassette 6*a* can be set lower.

Paper Feeding Unit According to a Second Embodiment

The paper feeding unit 6 according to this embodiment is the same as the paper feeding unit 6 according to the first embodiment except that a cam gear with shaft 121 is used instead of the cam gear 101 and the frame 213 on the paper feeding cassette 6*a* side has a fitting hole (explained later) through which a fitting shaft (explained later) of the cam gear with shaft 121 is inserted.

Figure 23:
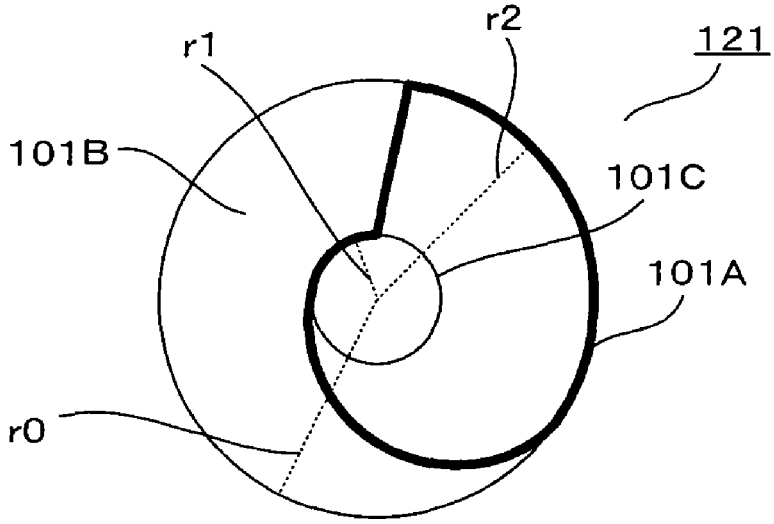
FIG. 23 is a front view of a cam gear with shaft.

FIG. 23 is a front view of the cam gear with shaft 121. As shown in FIG. 23, the cam gear with shaft 121 includes the base disc 101B, which is a disc perpendicular to a rotation axis, and the cam 101A set in contact with the base disc 101B.

The cam 101A is formed such that the radius thereof increases as an angle increases toward a rotating direction. The minimum radius r1 of the cam 101A is the same as the radius of the center cylinder 101C provided in the center of the cam gear with shaft 121. The maximum radius r2 of the cam 101A is the same as the radius r0 of the base disc 101B. A central angle at which the radius of the cam 101A is maximized is equal to or larger than 90° and equal to or smaller than 120°.

Figure 24:
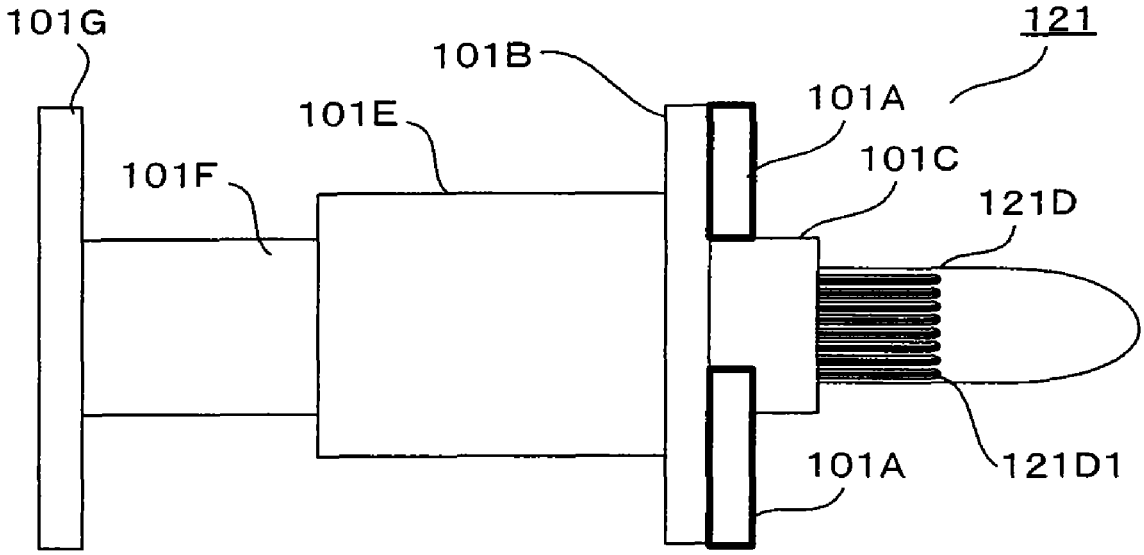
FIG. 24 is a side view of the cam gear with shaft.

FIG. 24 is a side view of the can gear with shaft 121. As shown in FIG. 24, the cam gear with shaft 121 includes the pressing disc 101G, the cylindrical section 101F, the gear section 101E, the base disc 101B, the cam 101A, the center cylinder 101C, and a fitting shaft 121D.

The pressing disc 101G is made of a disc perpendicular to the rotation axis of the cam gear with shaft 121. The diameter of the pressing disc 101G is larger than that of the cylindrical section 101F.

The diameter of the cylindrical section 101F is smaller than those of the pressing disc 101G and the gear section 101E. The gear section 101E has teeth of a toothed gear on the surface thereof. In FIG. 24, the teeth are not shown. The diameter of the gear section 101E is larger than that of the cylindrical section 101F and smaller than that of the base disc 101B.

The diameter of the center cylinder 101C is smaller than that of the base disc 101B. The center cylinder 101C has the fitting shaft 121D at an end thereof. The fitting shaft 121D has teeth 121D1 of a toothed gear in a root section thereof and is formed to taper toward the distal end thereof.

Figure 25:
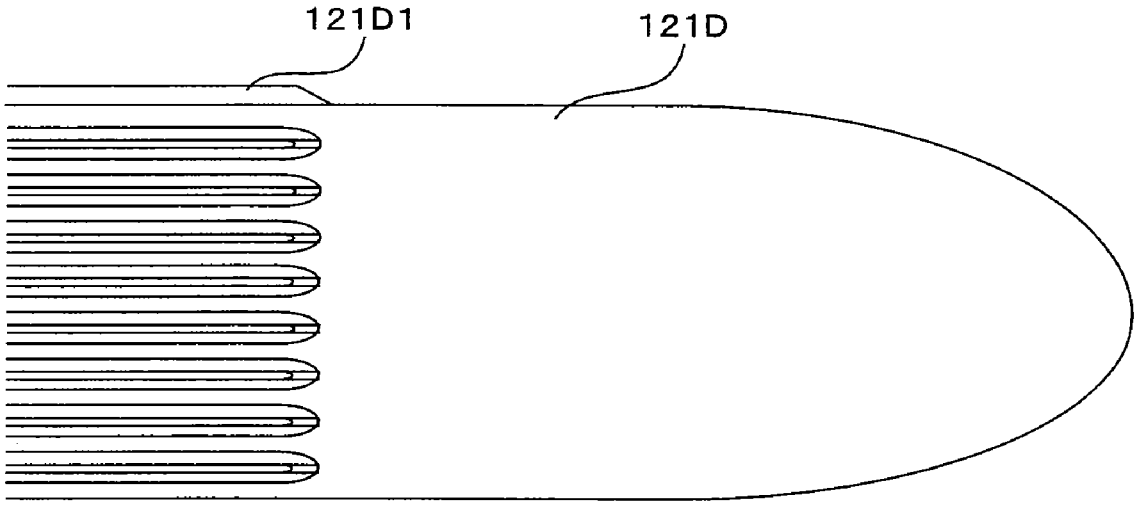
FIG. 25 is an enlarged side view of a fitting shaft.

FIG. 25 is an enlarged side view of the fitting shaft 121D. As shown in FIG. 25, the fitting shaft 121D has the teeth 121D1 of the toothed gear in the root section thereof. The teeth 121D1 are provided in parallel to a rotation axis of the fitting shaft 121D.

Figure 26:
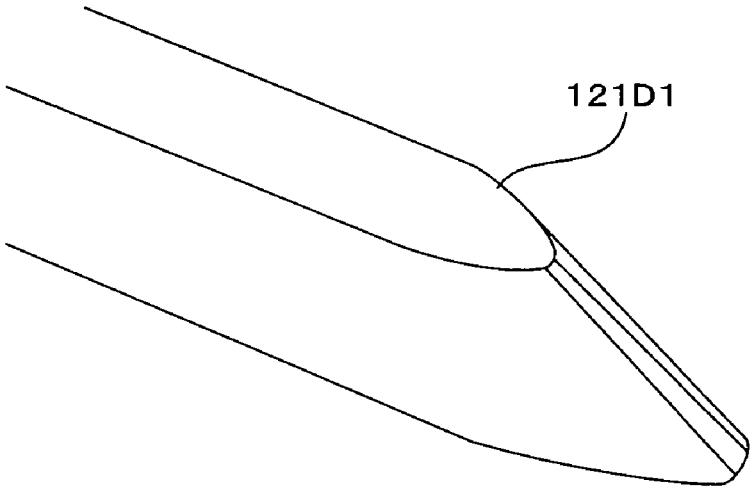
FIG. 26 is an enlarged perspective view of a distal end portion of a tooth.

FIG. 26 is an enlarged perspective view of the distal end portion of the tooth 121D1. As shown in FIG. 26, the tooth 121D1 is chamfered such that the height thereof gradually decreases and the width thereof gradually decreases toward the distal end. The distal end portion may be chamfered in a streamline shape.

Figure 27:
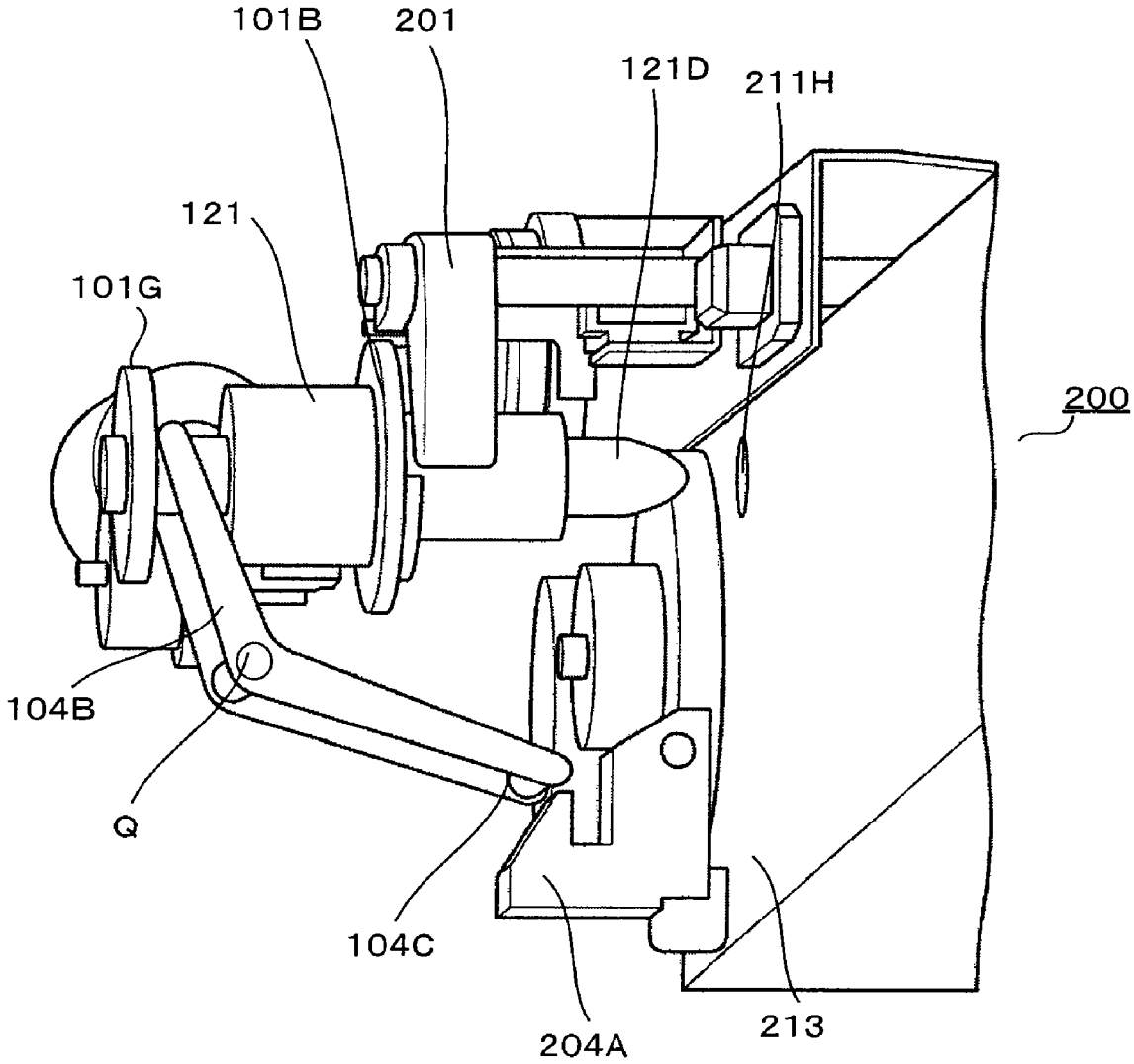
FIG. 27 is a perspective view of a state immediately after the start of the insertion of the paper feeding cassette.

FIG. 27 is a perspective view of a state immediately after the start of the insertion of the paper feeding cassette 6*a*. In an example shown in FIG. 27, the push-back arms 104B are used. The push-back levers 104 can also be used.

The frame 213 on the paper feeding cassette 6*a* side has a fitting hole 211H through which the fitting shaft 121D of the cam gear with shaft 121 is inserted.

Figure 28:
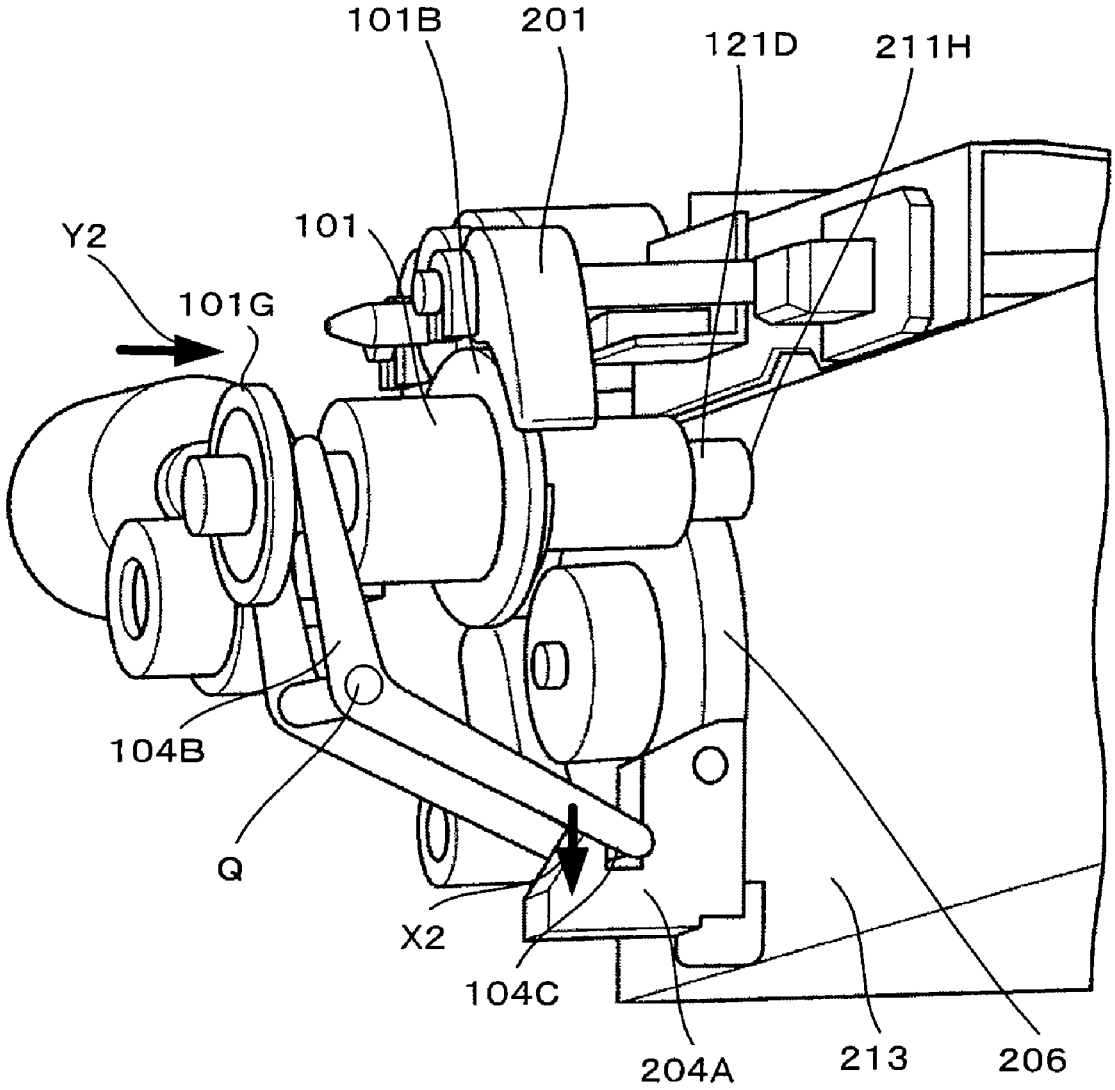
FIG. 28 is a perspective view of a state immediately after the completion of the insertion of the paper feeding cassette.

FIG. 28 is a perspective view of a state immediately after the completion of the insertion of the paper feeding cassette 6*a*. As shown in FIG. 28, the fitting shaft 121D is inserted into the fitting hole 211H. The teeth 121D1 of the fitting shaft 121D engage with teeth of the deceleration gear 206. Therefore, when the cam gear with shaft 121 rotates, the deceleration gear 206 rotates.

The teeth 121D1 are chamfered as explained above. Therefore, when the paper feeding cassette 6*a* is inserted, the teeth 121D1 smoothly engage with the teeth of the deceleration gear 206. Since the fitting shaft 121D is inserted into the fitting hole 211H, the teeth 121D1 and the teeth of the deceleration gear 206 that engage each other do not disengage.

The teeth 121D1 are provided in parallel to the rotation axis of the fitting shaft 121D. Therefore, when the paper feeding cassette 6*a* is inserted and removed, the teeth 121D1 can be easily engaged with and disengaged from the teeth of the deceleration gear 206.

Effect of this Embodiment

As explained above, in the pickup roller lifting and lowering mechanism and the image forming apparatus including the lifting and lowering mechanism according to this embodiment, the lifting and lowering driving mechanism 100 includes the cam gear with shaft 121 including the fitting shaft 121D. The frame 213 on the paper feeding cassette 6*a* side has the fitting hole 211H through which the fitting shaft 121D of the cam gear with shaft 121 is inserted. Therefore, there is an effect that the number of components can be further reduced.

Although exemplary embodiments of the present invention have been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. A pickup roller lifting and lowering mechanism of a paper feeding unit comprising;

a lifting and lowering driving mechanism having a base disc, which is a disc radially extending from a rotation axis of the lifting and lowering driving mechanism, and a cam that is set in contact with the base disc, the lifting and lowering driving mechanism including a cam gear urged in a direction opposite to an inserting direction of a paper feeding cassette in which recording media are stacked and a push-back mechanism that urges the cam gear in a direction opposite to the paper feeding cassette and releases the urging of the cam gear in the inserting direction of the paper feeding cassette by being pressed by a pressing projection provided in the paper feeding cassette;

a rotation lever rotated by the cam and the base disc;

a pickup roller lifting and lowering shaft rotated by the rotation lever; and a pickup roller lowered by the rotation of the pickup roller lifting and lowering shaft, having a pickup roller axis which is parallel to the inserting direction of the paper feeding cassette.

2. The pickup roller lifting and lowering mechanism according to claim 1, wherein the cam gear has a fitting section at a distal end in a direction of the paper feeding cassette, and the pickup roller lifting and lowering mechanism includes:

a gear section that fits with the fitting section and transmits rotation of the cam gear;

a tray lifting and lowering member that pivots according to rotation of the gear section; and a stacking tray on which the recording media are stacked, the stacking tray pushing up the recording media in a direction of the pickup roller with the tray lifting and lowering member.

3. The pickup roller lifting and lowering mechanism according to claim 2, wherein the cam gear stops for a predetermined time after rotating the rotation lever and starting lowering of the pickup roller and starts the rotation again and pushes up the stacking tray after the predetermined time elapses.

4. The pickup roller lifting and lowering mechanism according to claim 2, wherein the pickup roller lifting and lowering mechanism has a cassette-side fitting section that fits with the fitting section of the cam gear and transmits the rotation of the cam gear to the gear section.

5. The pickup roller lifting and lowering mechanism according to claim 2, wherein the cam gear includes a fitting shaft having, at a distal end in the direction of the paper feeding cassette, teeth that engage with a gear of the gear section, and the pickup roller lifting and lowering mechanism includes a fitting hole, through which the fitting shaft is inserted, in a paper feeding cassette side frame.

6. The pickup roller lifting and lowering mechanism according to claim 1, wherein the cam gear includes an elastic member that urges the cam gear in a direction of the paper feeding cassette, and the push-back mechanism includes an elastic member that urges the cam gear in a direction opposite to the direction of the paper feeding cassette.

7. The pickup roller lifting and lowering mechanism according to claim 1, wherein the pickup roller lifting and lowering mechanism includes a hook that pushes up the push-back mechanism in a paper feeding cassette side frame, and the push-back mechanism includes, at an end in a direction of the paper feeding cassette, a push-up pin that fits in the hook.

8. The pickup roller lifting and lowering mechanism according to claim 1, wherein a maximum radius of the cam is equal to a radius of the base disc.

9. The pickup roller lifting and lowering mechanism according to claim 1, further comprising:

a load sensor that detects a load; and a load actuator including a first screening member that interrupts an optical path of the load sensor when the paper feeding cassette is empty and a second screening member that interrupts the optical path of the load sensor when the paper feeding cassette is overloaded.

10. An image forming apparatus comprising:

an image reading unit that reads an image of an original document conveyed thereto or an original document placed thereon;

an image forming unit that forms, on the basis of an image signal output by the image reading unit, an image on a recording medium conveyed thereto; and a paper feeding unit that feeds the recording medium to the image forming unit, wherein the paper feeding unit includes a paper feeding cassette and a pickup roller lifting and lowering mechanism, and the pickup roller lifting and lowering mechanism includes:

a lifting and lowering driving mechanism having a base disc, which is a disc radially extending from a rotation axis, and a cam that is set in contact with the base disc, the lifting and lowering driving mechanism including a cam gear urged in a direction opposite to an inserting direction of the paper feeding cassette and a push-back mechanism that urges the cam gear in a direction opposite to the paper feeding cassette and releases the urging of the cam gear in the inserting direction of the paper feeding cassette by being pressed by a pressing projection provided in the paper feeding cassette;

a rotation lever rotated by the cam and the base disc;

a pickup roller lifting and lowering shaft rotated by the rotation lever; and a pickup roller lowered by the rotation of the pickup roller lifting and lowering shaft, having a pickup roller axis which is parallel to the inserting direction of the paper feeding cassette.

11. The apparatus according to claim 10, wherein the cam gear has a fitting section at a distal end in a direction of the rotation lever, and the pickup roller lifting and lowering mechanism includes:

a gear section that fits with the fitting section and transmits rotation of the cam gear;

a tray lifting and lowering member that pivots according to rotation of the gear section; and a stacking tray on which the recording media are stacked, the stacking tray pushing up the recording media in a direction of the pickup roller with the tray lifting and lowering member.

12. The apparatus according to claim 11, wherein the cam gear stops for a predetermined time after rotating the rotation lever and starting lowering of the pickup roller and starts the rotation again and pushes up the stacking tray after the predetermined time elapses.

13. The apparatus according to claim 11, wherein the pickup roller lifting and lowering mechanism has a cassette-side fitting section that fits with the fitting section of the cam gear and transmits the rotation of the cam gear to the gear section.

14. The apparatus according to claim 11, wherein the cam gear includes a fitting shaft having, at a distal end on a rotation roller side, teeth that engage with a gear of the gear section, and the pickup roller lifting and lowering mechanism includes a fitting hole, through which the fitting shaft is inserted, in a paper feeding cassette side frame.

15. The apparatus according to claim 10, wherein the cam gear includes an elastic member that urges the earn gear in a direction of the paper feeding cassette, and the push-back mechanism includes an elastic member that urges the cam gear in a direction opposite to the direction of the paper feeding cassette.

16. The apparatus according to claim 10, wherein the pickup roller lifting and lowering mechanism includes a hook that pushes up the push-back mechanism in a paper feeding cassette side frame, and the push-back mechanism includes, at an end in a direction of the paper feeding cassette, a push-up pin that fits in the hook.

17. The apparatus according to claim 10, wherein a maximum radius of the cam is equal to a radius of the base disc.

18. The apparatus according to claim 10, further comprising:

a load sensor that detects a load; and a load actuator including a first screening member that interrupts an optical path of the load sensor when the paper feeding cassette is empty and a second screening member that interrupts the optical path of the load sensor when the paper feeding cassette is overloaded.

* * * * *